US010971317B2

(12) United States Patent
Hanna et al.

(10) Patent No.: US 10,971,317 B2
(45) Date of Patent: Apr. 6, 2021

(54) MECHANICAL CLOSING OF A CURRENT INTERRUPTER

(71) Applicant: ABB SCHWEIZ AG, Baden (CH)

(72) Inventors: Robert L. Hanna, Enterprise, FL (US); Patrick Fischer-Carne, New Smyrna Beach, FL (US); Luciano DiMaio, Lake Mary, FL (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/566,458

(22) Filed: Sep. 10, 2019

(65) Prior Publication Data

US 2020/0111631 A1 Apr. 9, 2020

Related U.S. Application Data

(63) Continuation of application No. PCT/US2018/021979, filed on Mar. 12, 2018.

(60) Provisional application No. 62/469,757, filed on Mar. 10, 2017, provisional application No. 62/611,715, filed on Dec. 29, 2017.

(51) Int. Cl.

| | |
|---|---|
| ***H01H 33/14*** | (2006.01) |
| ***H01H 33/666*** | (2006.01) |
| ***H01H 33/66*** | (2006.01) |

(52) U.S. Cl.

CPC ..... *H01H 33/6662* (2013.01); *H01H 33/14* (2013.01); *H01H 33/6606* (2013.01); *H01H 2033/6667* (2013.01)

(58) Field of Classification Search

CPC ..... H01H 33/6662; H01H 33/6606; H01H 33/14; H01H 47/00; H01H 50/00; H01H 50/10; H01H 2033/6667; H01H 33/38; H01H 33/40; H01H 71/2454; H01H 9/563

USPC ..... 218/120, 134, 139, 141, 153, 154, 152, 218/118; 200/12; 335/6, 16, 151, 201,
(Continued)

(56) References Cited

U.S. PATENT DOCUMENTS 3,471,814 A * 10/1969 Burdett ..... H01F 7/1638 335/174

3,813,506 A 5/1974 Mitchell (Continued)

OTHER PUBLICATIONS

International Searching Authority, International Search Report & Written Opinion in Correlation with PCT/US20181021979, dated Jul. 6, 2018, 10 Pages. US International Searching Authority, Alexandria, VA.

*Primary Examiner* — William A Bolton
(74) *Attorney, Agent, or Firm* — Taft Stettinius and Hollister LLP

(57) ABSTRACT

Recloser apparatuses, methods and systems are disclosed. In one embodiment a recloser includes a vacuum interrupter coupled with first and second electrical terminals. A driving structure is coupled with the vacuum interrupter. An electromagnetic actuator is coupled with the driving structure and is moveable to a first position to open the vacuum interrupter and to a second position to close the vacuum interrupter. A mechanical opening/closing mechanism includes a handle and a mechanical connection driving structure. The handle is moveable to move the vacuum interrupter to the first position and the second position. A control circuit is provided in communication with the electromagnetic actuator and is operable to actuate the electromagnetic actuator to move the vacuum interrupter between the first position and the second position.

22 Claims, 13 Drawing Sheets

(58) Field of Classification Search
USPC ..... 335/202, 12; 307/137; 361/152, 154, 361/160
See application file for complete search history.

(56) References Cited

U.S. PATENT DOCUMENTS

| | | | | |
|---|---|---|---|---|
| 4,187,482 | A | 5/1980 | Kosup | |
| 5,834,725 | A * | 11/1998 | Clarke | H01H 33/128 218/120 |
| 5,912,604 | A * | 6/1999 | Harvey | H01H 33/6662 218/138 |
| 6,198,062 | B1 * | 3/2001 | Mather | H01H 33/022 218/120 |
| 6,291,911 | B1 | 9/2001 | Dunk et al. | |
| 7,215,228 | B2 * | 5/2007 | Rhein | H01H 33/6662 335/6 |
| 7,843,293 | B1 * | 11/2010 | Bonjean | H01H 3/28 335/230 |
| 9,293,243 | B2 * | 3/2016 | Kim | H01F 7/1615 |
| 2014/0218138 | A1 | 8/2014 | Bianco et al. | |
| 2014/0218838 | A1 | 8/2014 | Mannino et al. | |

* cited by examiner

MECHANICAL CLOSING OF A CURRENT INTERRUPTER

RELATED APPLICATIONS

The present application claims priority to and the benefit of U.S. Application No. 62/469,757, filed Mar. 10, 2017, and U.S. Application No. 62/611,715, filed Dec. 29, 2017, and the same are hereby incorporated by reference.

BACKGROUND

The present disclosure relates to recloser devices for power distribution systems. Electrical power distribution systems may include recloser devices configured to interrupt current transmission upon the occurrence and/or detection of certain conditions or events, including, for example, detection of a fault current, and to thereafter attempt to automatically reclose the circuit by operating an electromagnetic actuator. The operation of electromagnetically actuated reclosers is dependent on the availability of electrical energy. For example, operation of electromagnet actuators typically involves electrical energy being applied to the actuator that facilitates the opening and/or closing of the current interrupter of the recloser. In at least certain situations, the electrical energy applied to the electromagnetic actuator can be provided by one or more electrical storage devices of the recloser. When primary power is flowing through the recloser, a portion of the supplied primary power can be harvested and stored in capacitors, batteries or other electrical energy storing devices or components of the recloser. Accordingly, in the event that the recloser has been opened, electrical energy stored by the electrical storage devices can be applied to the recloser so that the recloser can be operated to return the recloser, at least momentarily, to the closed position. However, at least in certain situations, the recloser and associated electronics can cease to receive a supply of primary electrical power for relatively prolonged periods of time. Such unavailability of primary power can result in stored electrical power that was used by the recloser not being replenished, and/or the dissipation of at least a portion of the stored electrical power. The stored electrical power, if any, can thus become insufficient to effectuate operation of the recloser, which can result in the recloser remaining in the open position.

DISCLOSURE OF ILLUSTRATIVE EMBODIMENTS

For the purposes of clearly, concisely and exactly describing illustrative embodiments of the present disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

BRIEF DESCRIPTION OF THE DRAWINGS

The description herein makes reference to the accompanying figures wherein like reference numerals refer to like parts throughout the several views.

DETAILED DESCRIPTION

Figure 1:
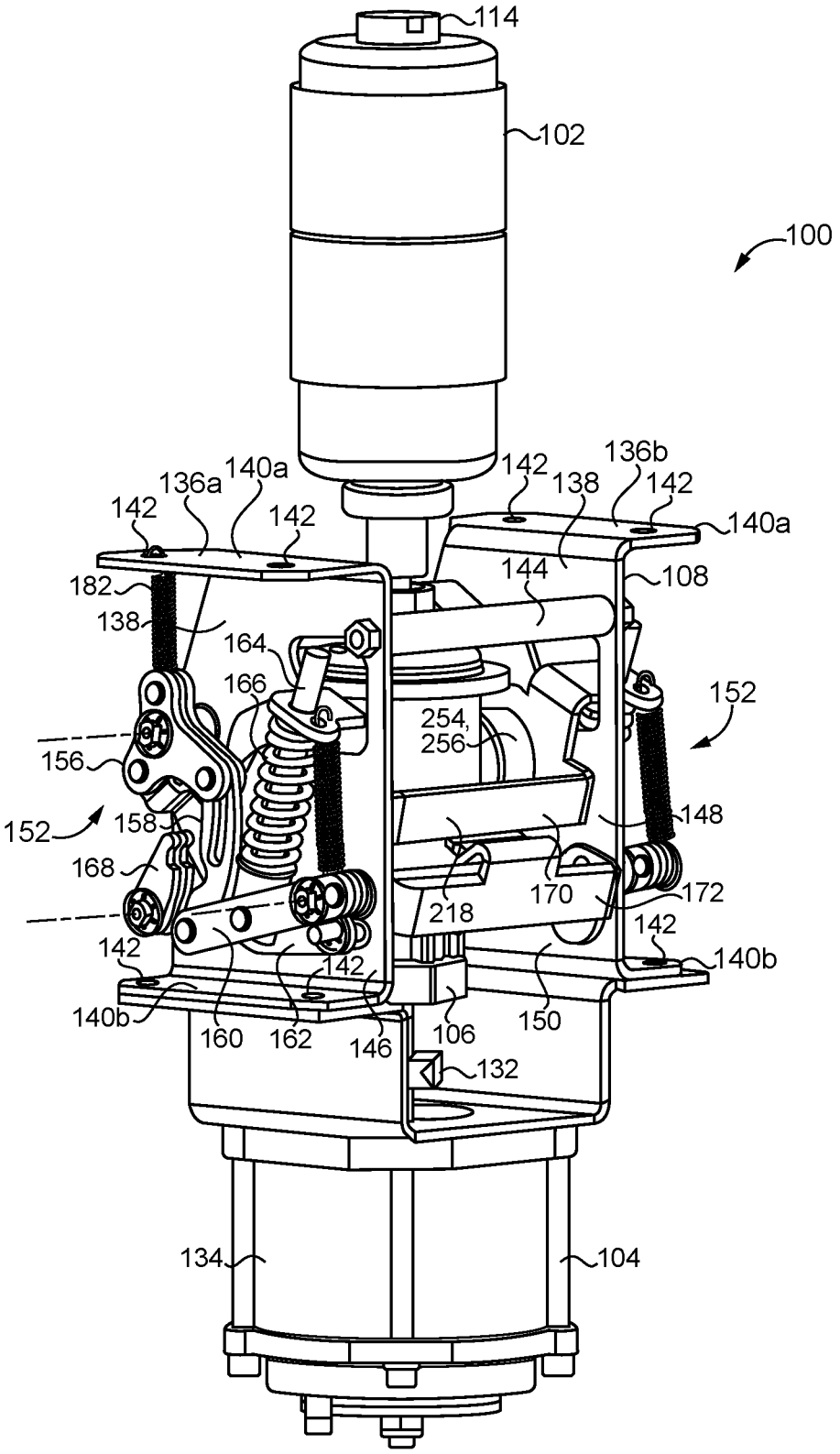
FIG. 1 illustrates a front side perspective view of a recloser according to an exemplary embodiment of the present application.
Figure 4:
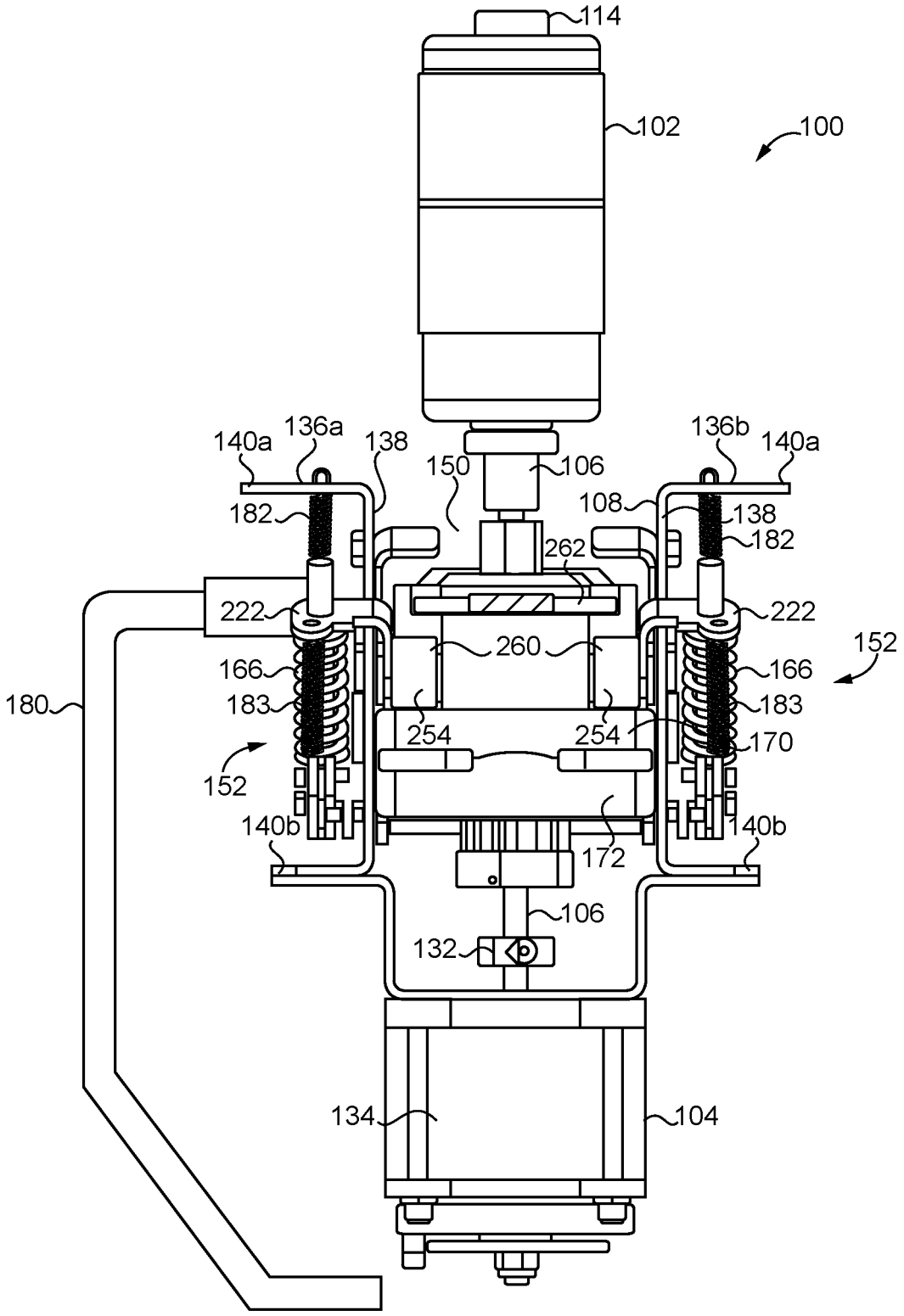
FIG. 4 illustrates a front view of the recloser depicted in FIG. 1.
Figure 5B:
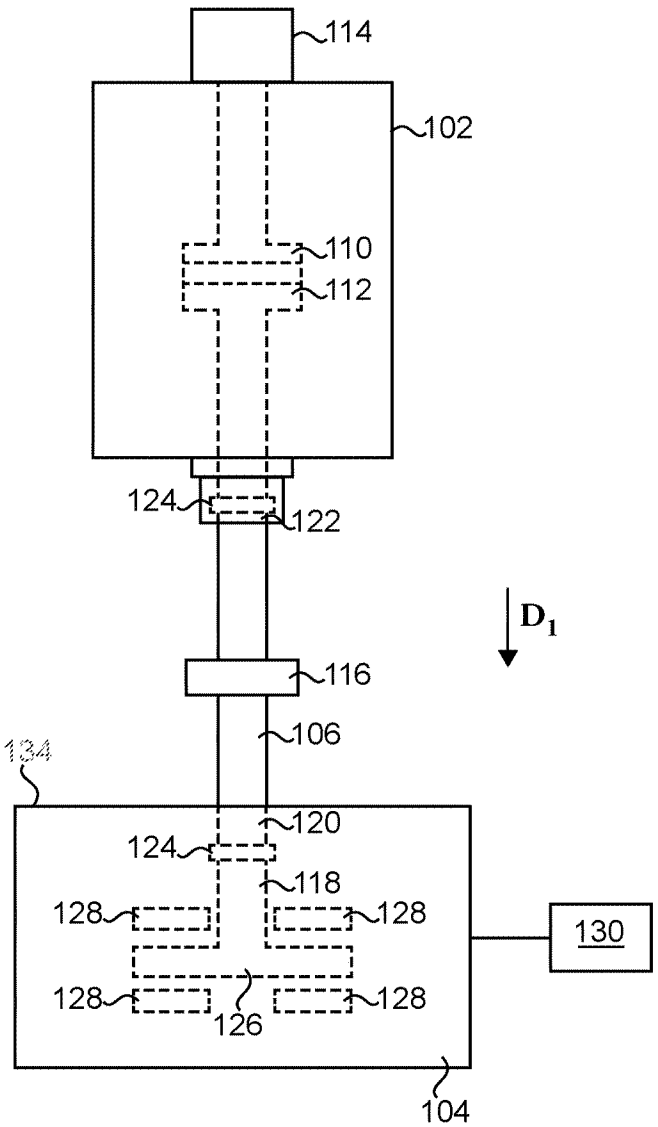
FIGS. 5A and 5B illustrate a schematic representation of portions of a recloser in closed and opened positions, respectively.
Figure 5A:
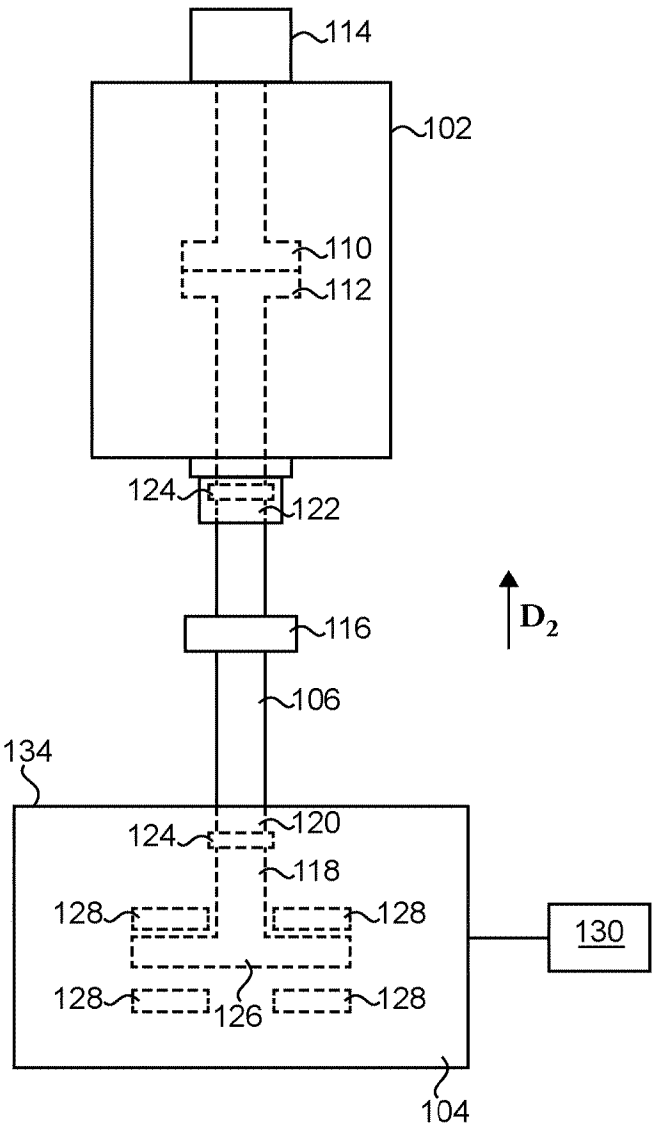

FIGS. 1 and 4 illustrate an exemplary recloser 100 according to certain embodiments of the subject application. The recloser 100 can include a current interrupter 102, an electromagnetic actuator 104, a pushrod 106, and a closing mechanism 108. A variety of different types of current interrupters can be used as the current interrupter 102 for the recloser 100, including, for example, an embedded vacuum interrupter and a gas current interrupter, among other types of current interrupters. For at least purposes of discussion, FIGS. 5A and 5B depict a schematic representation of portions of an exemplary current interrupter 102. As shown, the current interrupter 102 can include a fixed contact 110 and a moveable contact 112, the fixed contact 110 being electrically coupled to a first, upper terminal 114, and the moveable contact 112 being electrically coupled to a second, lower terminal 116. The first terminal 114 can provide an incoming flow or supply of electricity to the recloser 100. Accordingly, when the current interrupter 102 is in a closed position, as shown for example in FIG. 5A, the fixed contact 110 is electrically coupled to, or otherwise in operable contact with, the moveable contact 112, such that the incoming supply or flow of electricity can pass from the first terminal 114 and fixed contact 110 to the moveable contact 112, eventually to the lower, second terminal 116. According to certain embodiments, the second terminal 116 can be operably coupled to a current transmission line, among other components. Further, prior to flowing to the lower, second terminal 116, the electricity supplied to the current interrupter 102 can flow through a variety of other components or devices of, or coupled to, the recloser 100, including, for example, a current sensor and a transformer, among other components and devices.

Conversely, when the current interrupter 102 is in an open position, as shown for example by FIG. 5B, the moveable contact 112 can be positioned away from the fixed contact 110 such that the moveable contact 112 is no longer electrically coupled to the fixed contact 110. For example, in the embodiment depicted in FIG. 5B, the fixed contact has been generally linearly displaced in a first direction (as indicated by direction "$D_1$" in FIG. 5B) away from the fixed contact 110 such that the moveable contact 112 is no longer electrically coupled to the fixed contact 110, and the current interrupter is thus open. Accordingly, when the current interrupter 102 is in the open position, electricity cannot flow through the current interrupter 102, and thus the flow of current to at least the second terminal 116 is interrupted.

According to the illustrated embodiment, an electromagnetic actuator 102 can be electrically controlled to displace the moveable contact 112 away from, as well as toward, the fixed contact 110 so that the current interrupter 102 is selectively placed in the corresponding open or closed positions. While the recloser 100 can employ a variety of different types of electromagnetic actuators, according to the illustrated embodiment, the illustrated electromagnet actuator includes an actuator arm 118 that is coupled to a first end 120 of the pushrod 106, a second end 122 of the pushrod 106 being coupled to the moveable contact 112. While the first and second ends 120, 122 of the pushrod 106 can be coupled to the actuator arm 118 and the moveable contact 112, respectively, in a variety of different manners, as shown by the schematics of FIGS. 5A and 5B, according to the illustrated embodiment, the pushrod 106 can be coupled to each of the actuator arm 118 and the moveable contact 112 by a mechanical coupler(s) 124. Further, according to certain embodiments, the pushrod 106 can comprise a plurality or assembly of components, devices, and/or parts.

According to certain embodiments, the actuator arm 118 can include an armature 126 that is constructed from an electrically conductive material, such as, for example, aluminum or copper. Further, according to certain embodiments, the electromagnetic actuator 104 can include one or more primary coils 128 that can comprise a conductor that is wound in a number of turns, and which is connected to a power source 130. For example, the primary coil(s) 128 of the electromagnetic actuator 104 can be connected to a primary power source 130 through which electrical power is provided to the recloser 100, and/or to power source 130 in the form of one more power storage devices or components, such as, for example, one or more capacitors or a capacitor bank of the electronics associated with the recloser 100 and/or electromagnetic actuator 104, among other storage devices and components. Additionally, according to certain embodiments, rather than including an armature 126, the actuator arm 118 can include coils that are wound in a direction opposite to that of the primary coils 128 of the electromagnetic actuator 104, and which can be electrically coupled to the power source 130.

When the electromagnetic actuator 104 is to open the current interrupter 102, such as, for example, upon detection of a fault current, the power source 130 can provide a current that flows through the primary coil(s) 128 of the electromagnetic actuator 104 in a manner that generates a relatively strong magnetic field around the primary coil(s) 128. The generated magnetic field can induce eddy currents in the armature 126 of the actuator arm 118 in a manner that repels, or otherwise displaces, via an electromagnetic force, the armature 126 generally in the first direction ("$D_1$" in FIG. 5B) and away from the primary coil(s) 128. As the actuator arm 118 is coupled to the moveable contact 112 via the pushrod 106, such displacement of the armature 126 can facilitate displacement of the moveable contact 112 away from the fixed contact 110 so as to open the current interrupter 102, as shown in FIG. 5B.

The distance the pushrod 106, and thus at least the moveable contact 112, can be displaced in the first direction (as indicated by direction "$D_1$" in FIG. 5B), can be limited in a variety of different manners, including, for example, by the relatively secure attachment of a limiting body 132 to at least a portion of the pushrod 106 relative to a portion of the electromagnetic actuator 104, as shown for example, in at least FIGS. 1 and 4. Moreover, when the pushrod 106 is being displaced generally in the first direction when current interrupter 102 is being opened, the limiting body 132 can be moved into contact with the electromagnetic actuator 104, such as, for example, a housing 134 of the electromagnetic actuator 104, among other portions of the electromagnetic actuator 104, which can prevent further displacement of at least the pushrod 106 in the first direction.

According to certain embodiments, after facilitating the opening of the current interrupter 102, current provided by the power source 130 can flow through the primary coil(s) 128 in a manner or direction that attracts the armature 126 toward the primary coil(s) 128. Such displacement of the armature 126, and thus the pushrod 106 and the moveable contact 112 coupled thereto, can generally be in a second linear direction (as indicated by "$D_2$" in FIG. 5A) so that the moveable contact 112 can be moved to a position at which the moveable contact 112 becomes electrically coupled with the fixed contact 110. As previously discussed, with the moveable contact 112 electrically coupled to the fixed contact 110, the current interrupter 102 can again be in the closed position, as generally indicated in FIG. 5A.

In certain situations, when the current interrupter 102 is in the open position, the power source 130 may be unavailable, or otherwise may have insufficient power to facilitate displacement, via operation of the electromagnetic actuator 104, of at least the pushrod 106 in the second direction. Further, with the current interrupter 102 opened for a certain duration of time, energy storage devices, such as, for example, one or more capacitors or capacitor banks of the power source 130, can be depleted such that insufficient current is unavailable to operate the electromagnetic actuator 104 in a manner that can facilitate the closing of the opened current interrupter 102. In such situations, the closing mechanism 108 can, as discussed below, be operated to release mechanical energy that is stored by the closing mechanism 108 to close the recloser 100, and moreover, close the current interrupter 102 via mechanical, rather than magnetic, displacement of the pushrod 106. Such closing of the current interrupter 102 can, if primary power is available, facilitate a supply of energy for storage by the power source 130 and/or for operation of the electromagnetic actuator 104 such that the electromagnetic actuator 104 can subsequently, in a relatively short time period, be capable of re-opening the closed current interrupter 102. Thus, as discussed below, in addition to being configured to mechanically close the opened recloser 100, and more specifically the current interrupter 102, at least a portion of the closing mechanism 108 can also be configured to relatively quickly be displaced to a position that prevents the closing mechanism 108 from interfering with potential subsequent reopening of the current interrupter 102 by operation of the electromagnetic actuator 104.

As shown in at least FIGS. 1-4, according to the illustrated embodiment, the closing mechanism 108 can include opposing first and second closer brackets 136*a*, 136*b*. According to the illustrated embodiment, one or both of the first and second closer brackets 136*a*, 136*b* can include a sidewall 138, a first attachment flange 140*a*, and a second attachment flange 140*b*, the sidewall 138 being generally positioned between the first and second attachment flanges 140*a*, 140*b*. Further, the first and second attachment flanges 140*a*, 140*b* can generally extend outwardly from upper and lower portions, respectively, of the sidewall 138. According to the illustrated embodiment, the first and second attachment flanges 140*a*, 140*b* can generally be orthogonal to the sidewall 138. Additionally, the first and second attachment flanges 140*a*, 140*b* can be configured to attach the closing mechanism 108 to other components and/or brackets 136*a*, 136*b* of the recloser 100, among other components. For example, according to certain embodiments, the first and second attachment flanges 140*a*, 140*b* can include one or more through-holes 142 sized to receive insertion of a mechanical fastener, such as, for example, a bolt, screw, pin, and/or nut, among other fasteners. Additionally, according to certain embodiments, one or more of the through-holes 142 can include an internal thread.

According to certain embodiments, the first closer bracket 136*a* can be coupled at one or more locations to the second closer bracket 136*b*. For example, as shown in at least FIG. 1, the first closer bracket 136*a* can be attached to the second closer bracket 136*b* by one or more extension members 144 that passes through apertures in the first and second closer brackets 136*a*, 136*b*. In the illustrated embodiment, opposing ends of the extension member 144 can be threadingly secured to a nut, among other manners or attachment. Further, the extension member(s) 144 can be sized to separate the first and second closer brackets 136*a*, 136*b* by a predetermined distance. However, the first and second closer brackets 136*a*, 136*b* can be secured relative to each other in a variety of other manners.

The sidewall 138 of the first and second closer brackets 136*a*, 136*b* can include and an outer surface 146 and an inner surface 148. The inner surfaces 148 of the sidewalls 138 of the first and second closer brackets 136*a*, 136*b* can generally define an interior region 150 of the closing mechanism 108 that houses at least a portion components of the closing mechanism 108 that can selectively physically engage or contact at least a portion of the pushrod 106 to mechanically displace the pushrod 106 in a the second direction (as generally indicated by direction "$D_2$" in FIG. 5A) to a position that closes the current interrupter 102, as discussed below. Additionally, the outer surface 146 of one or both of the first and second closer brackets 136*a*, 136*b* can generally be adjacent to at least a portion of a linkage system 152 of the closing mechanism 108 that can store, as well as release, the mechanical force used to displace the pushrod 106 to facilitate the closing of an opened current interrupter 102.

For at least purposes of discussion, the linkage system 152 is discussed below with respect to the first closer bracket 136*a*. However, according to certain embodiments, the below discussed a similar linkage system 152 can also, or, optionally, alternatively, be positioned about the second closer bracket 136*b*. Thus, as indicated by at least FIGS. 1 and 4, according to certain embodiments, linkage systems 152 can be positioned adjacent to the outer surfaces 146 of the sidewalls 138 of both the first and second closer brackets 136*a*, 136*b*. According to certain embodiments, each linkage system 152 can include a secondary latch lever 154, a driving fork 156, a link guide 158, a spring arm 160, a release link 162, a guide body 164, a biasing element 166, a close latch 168, a main bracket 170, and a release bracket 172.

The driving fork 156 is rotatably coupled to the sidewall 138. According to certain embodiments, the driving fork 156 can rotate about a central axis 174 (FIG. 2A) that is generally perpendicular to the above-discussed first and second linear directions of displacement of the pushrod 106. According to the illustrated embodiment, the driving fork 156 can have an outwardly radially extending first leg 176*a*, second leg 176*b*, and third leg 176*c*. Further, one or more of the first, second, and third legs 176*a-c* can have a different length than at least another leg 176*a-c*. As shown in at least FIGS. 2A and 2B, according to the illustrated embodiment, the first, second, and third legs 176*a-c* can be arranged to provide the driving fork 156 with a generally triangular shape.

The driving fork 156 can also include, or be coupled to, a driven hub 178 that is configured for selective coupling of the driving fork 156 with a driver 180 (FIG. 4), such as, for example, a handle. For example, the driven hub 178 can have a configuration that accommodates mating engagement of the driven hub 178 with the driver 180 such that rotational displacement of the driver 180 can be translated to the driving fork 156 via the driven hub 178. According to certain embodiments, the driven hub 178 is a non-round protrusion, such as, for example, a protrusion having at least one outer flat side edge such that rotation of the driver 180 can be translated to rotational displacement of at least the driven hub 178. While the driver 180 illustrated in FIG. 4 is depicted as a handle that engages a single driver, the driver 180 can have a variety of other configurations, shapes, and sizes, including, for example, a driver 180 that can simultaneously engage a driven hub 178 of two linkage systems 152, one of each linkage systems 152 being adjacent to outer surfaces of opposing closer brackets 136*a*, 136*b*. Further, such rotational displacement of the driver 180 can include, for example, lifting the driver 180 from a lower position, such as, for example, a vertical positioned generally aligned with or below the electromagnetic actuator 104, in a direction generally toward of the current interrupter 102 and/or pulling the driver 180 from an upper position, such as, for example a vertical position generally aligned with or above the current interrupter 102, in a direction generally toward the electromagnetic actuator 104.

Figure 2A:
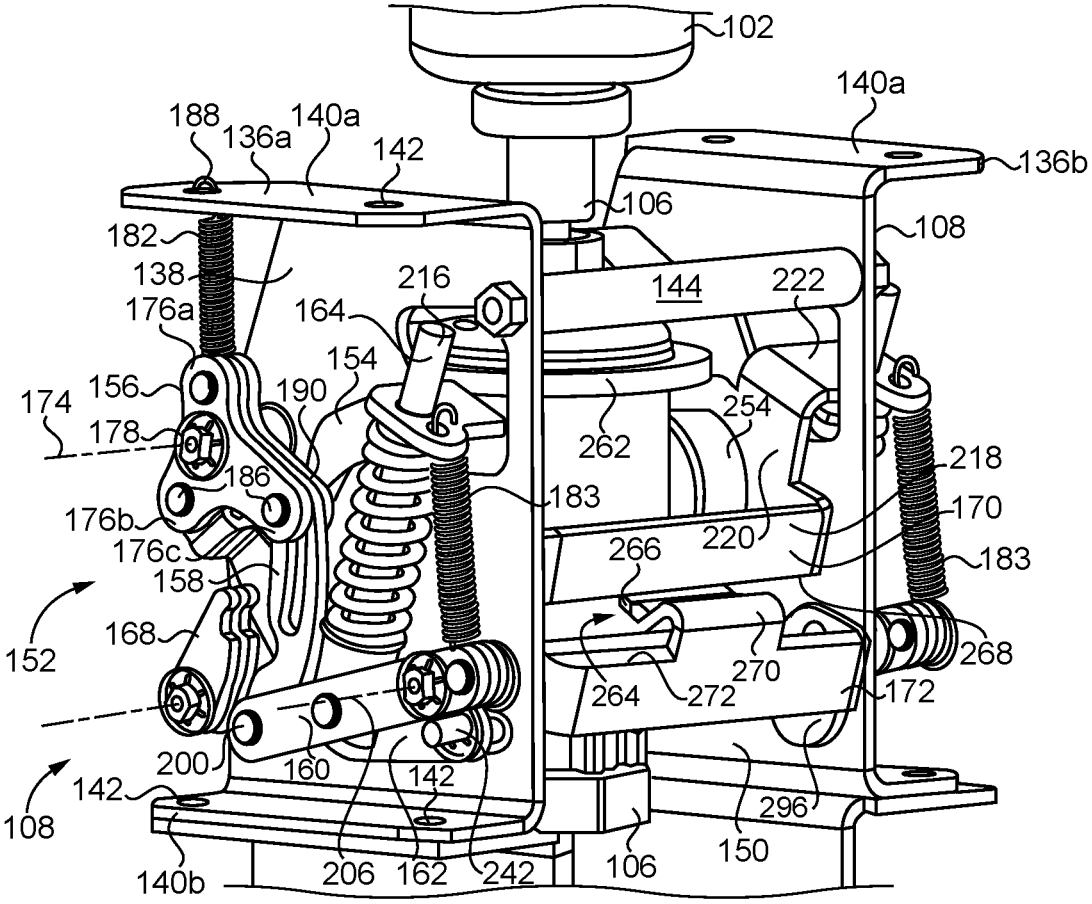
FIGS. 2A and 2B illustrate a front side perspective view and a side view, respectively, of a closing mechanism of the recloser depicted in FIG. 1.
Figure 2B:
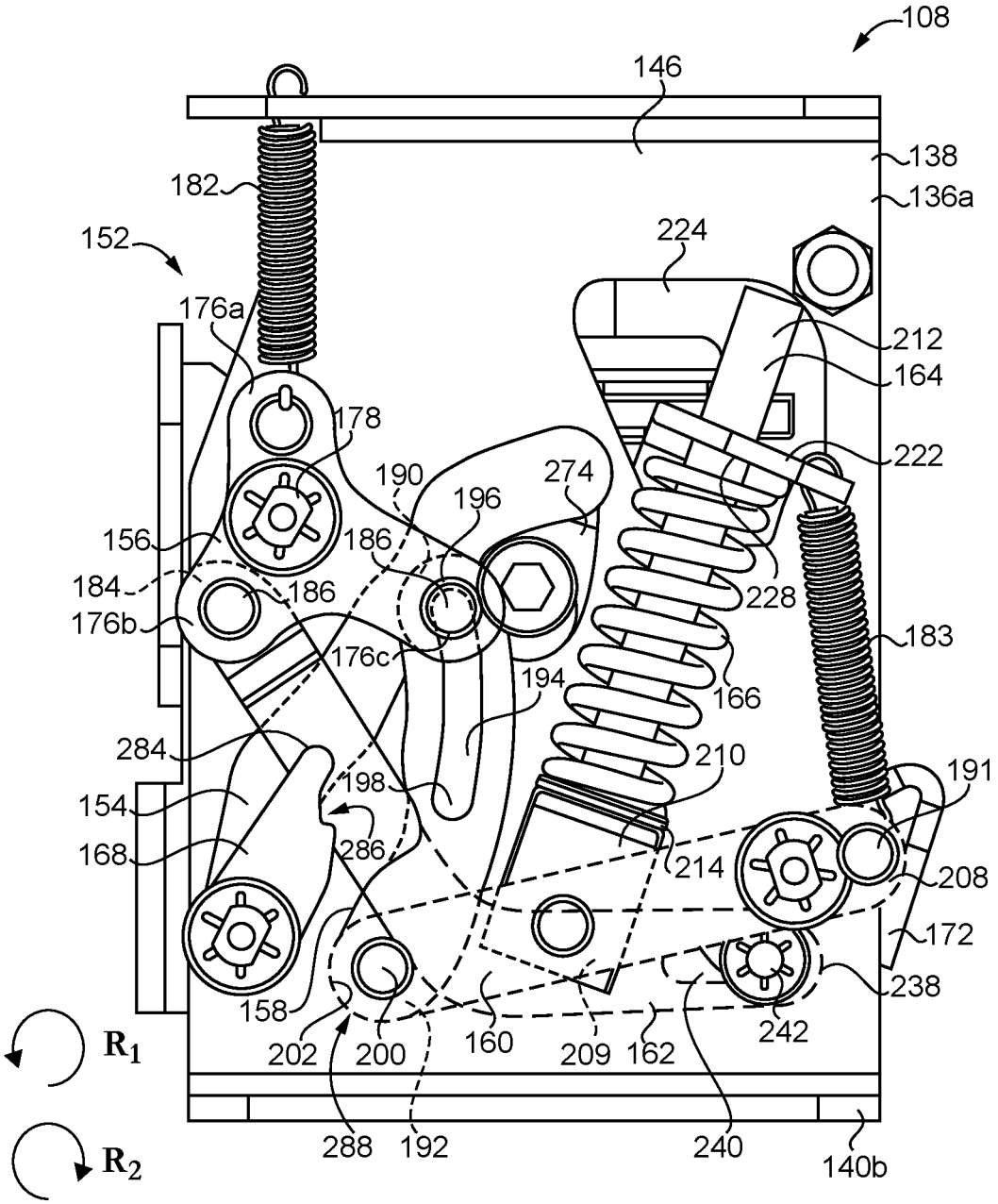
Figure 3A:
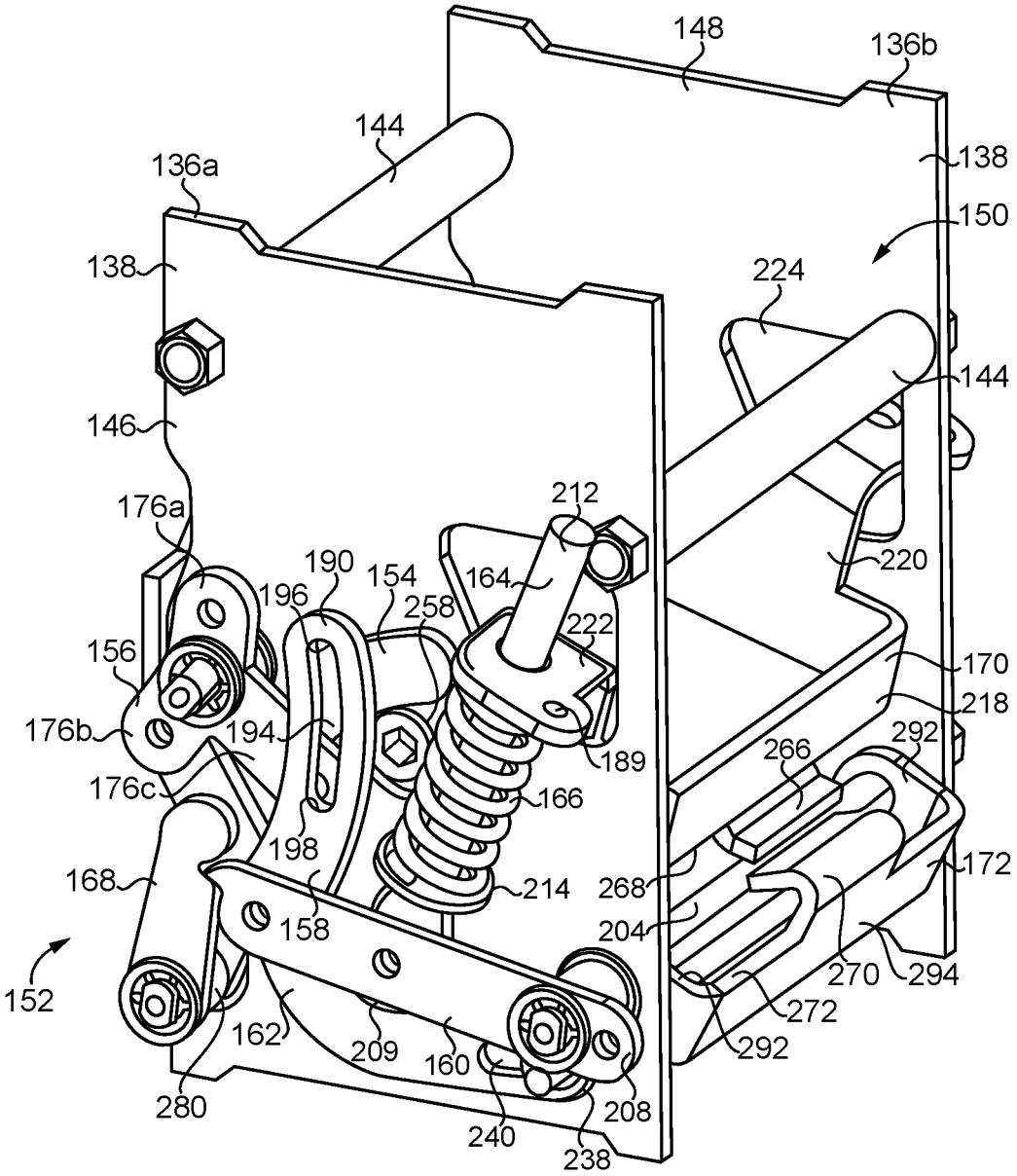
FIGS. 3A and 3B illustrate front and rear side perspective views, respectively, of a portion of the closing mechanism shown in FIG. 1, as well as a phantom view of a portion of a pushrod.
Figure 3B:
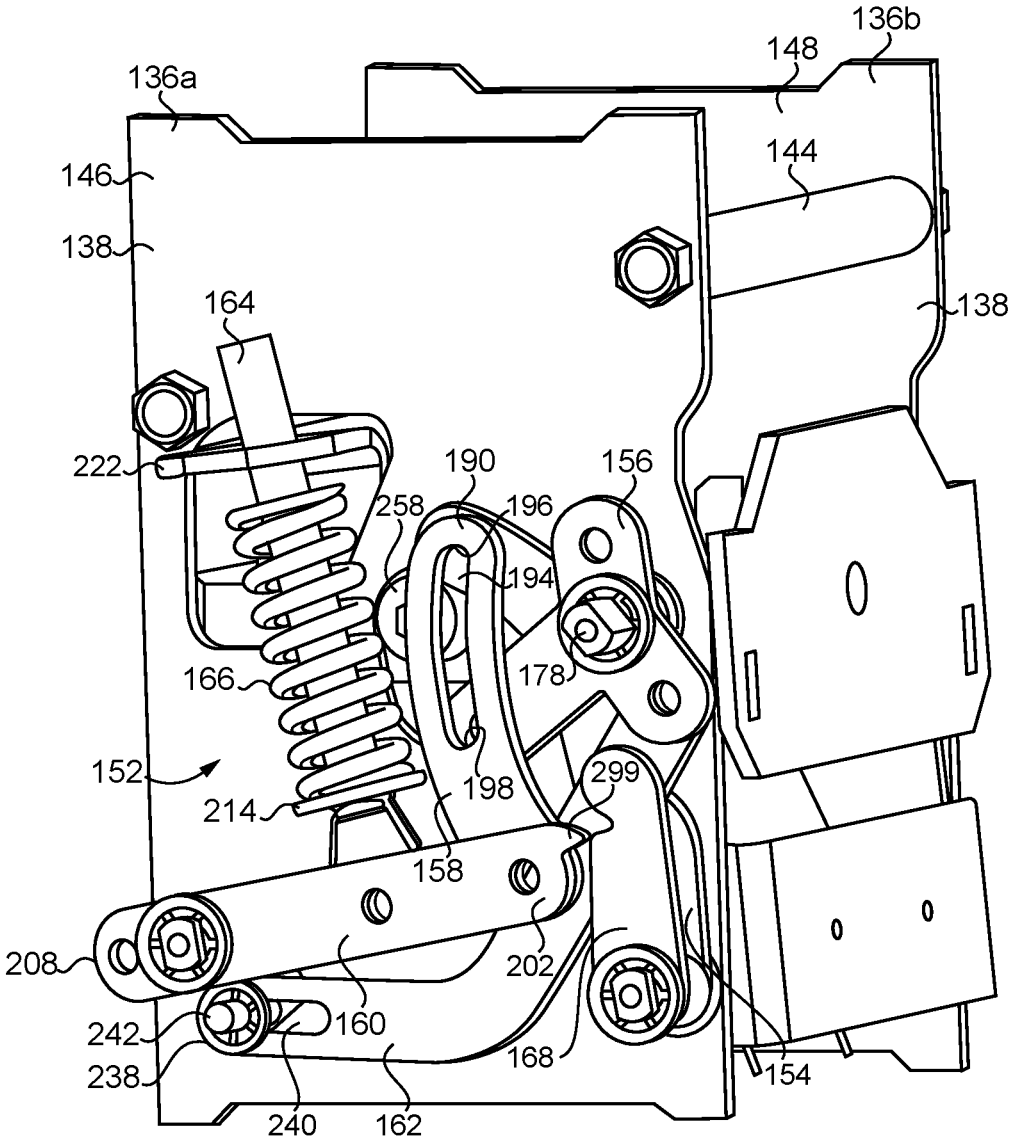

The first leg 176*a* of the driving fork 156 can be coupled to a secondary biasing element 182, such as, for example, a spring, that can be configured to assist in biasing the driving fork 156 to a neutral position, as shown, for example, in at least FIGS. 2A and 2B. According to certain embodiments, a first end of the secondary biasing element 182 can include a hook or other attachment structure that can be relatively securely coupled to the first leg 176*a*, such as, for example, extend into an aperture or through-hole in the first leg 176*a* to securely engage an adjacent portion of the first leg 176*a*. A second, opposing end 188 of the secondary biasing element 182 can be attached to a portion of the first closer bracket 136*a*, such as, for example, coupled to the first attachment flange 140*a*. For example, the second end 188 of the secondary biasing element 182 can extend through a through-hole 142 in the first attachment flange 140*a* and securely engage an adjacent portion of the first attachment flange 140*a*.

As shown by at least FIGS. 2A and 2B, according to the illustrated embodiment, when the driving fork 156 is in the neutral position, the first leg 176*a* outwardly extends in a direction that is generally parallel to the path of linear displacement of the pushrod 106 when the current interrupter 102 is being opened and/or closed. As discussed below, and in relation to at least the orientation depicted in FIG. 2B, in at least certain situations, the driving fork 156 can be rotatably displaced in a first, counterclockwise direction (as indicated by "$R_1$" in FIG. 2B), or, alternatively, and a second, clockwise direction (as indicated by "$R_1$" in FIG. 2B), in response to a rotational force being translated to the driving fork 156 via operation of the driver 180, and/or in response to a rotational force(s) generated during at least operation of the closing mechanism 108. In such situations, upon the removal of such rotational forces and/or such rotational forces being insufficient to overcome the biasing force of the secondary biasing element 182, the secondary biasing element 182 can provide a force(s) that returns the driving fork 156 generally back to the neutral position.

Additionally, as also discussed below, the second leg 176*b* of the drive fork 156 can be pivotally coupled to a first end 184 of the release link 162, while the third leg 176*c* can be coupled to the link guide 158. For example, according to certain embodiments, a guide pin 186 can extend through a through-hole of, or otherwise project from, each of the second and third legs 176*b*, 176*c* in a manner that rotatably couples the second and third legs 176*b*, 176*c* to the secondary latch lever 162 and the link guide 158, respectively.

As shown in at least FIGS. 2A-3B, the link guide 158 can include a first end 190, a second end 192, and an elongated guide slot 194. According to the illustrated embodiment, the link guide 158 has a generally curved or arced shape. The elongated guide slot 194 can extend between a first slot end 196 and a second slot end 198, the first slot end 196 being in relatively close proximity to, or otherwise generally adjacent to, the first end 190 of the link guide 158. Further, at least the elongated guide slot 194 can have generally curved or arced shaped that follows the arcuate path of travel of the third leg 176*c* associated with the rotational displacement of the driving fork 156. For example, according to certain embodiments, the elongated guide slot 194 can have a curved shape such that the guide pin 186 that is coupled to the third leg 176*c* and which is positioned within the elongated guide slot 194 can travel between the first and second slot ends 196, 198 of the elongated guide slot 194 as the driving fork 156 is rotated while the link guide 158 remains relatively static. Further, according to such an embodiment, the first slot end 196 can be positioned such that when the driving fork 156 is rotated in the first, counterclockwise direction, as shown in relation to the orientation of the linkage system 152 depicted in at least FIG. 2B, the guide pin 186 can be displaced to a position at which the guide pin 186 can exert a force against the link guide 158 at or around the first slot end 196 that facilitates at least similar pivotal displacement of the link guide 158 in the first, counterclockwise direction. Similarly, the second slot end 198 can be positioned such that when the driving fork 156 is rotated in the second, clockwise direction, the guide pin 186 can be displaced to a position at which the guide pin 186 can generally be positioned at or around the second slot end 198 such that the guide pin 186 is not positioned to interfere with subsequent displacement of the link guide 158 as the link guide 158 is subsequently displaced relative the guide pin 186.

The link guide 158 can also be pivotally coupled to the spring arm 160. More specifically, according to the illustrated embodiment, the second end 192 of the link guide 158 can be pivotally coupled, such as, for example, by an arm pin 200, to the spring arm 160 at or around a first end 202 of the spring arm 160. According to certain embodiments, the arm pin 200 can be a pin or mechanical fastener that extends at least partially through orifices of the link guide 158 and spring arm 160. Alternatively, according to other embodiments, the arm pin 200 can be a protrusion of one of the link guide 158 and spring arm 160 that is received in an opening in the other of the link guide 158 and spring arm 160.

The spring arm 160, at or around a second end 208 of the spring arm 160, can also be pivotally coupled to a release bracket shaft 204 (FIGS. 3A and 8) such that the spring arm 160 is pivotable relative to at least the sidewall 138 of the adjacent closer bracket 136*a*, 136*b* about a central axis 206 (FIG. 2A). According to certain embodiments, at least one of the spring arm 160, the release bracket shaft 204, and/or other associated coupling device(s), including, for example, a pin or bolt, among other devices or components, can extend through an aperture in the sidewall(s) 138 of the adjacent closer bracket 136*a*, 136*b*. Further, the central axis 206 about which at least the spring arm 160 pivotally rotates relative to the adjacent closer bracket 136*a*, 136*b* can be generally parallel to the central axis 174 about which the link guide 158 rotates relative to the adjacent closer bracket 136*a*, 136*b*.

The spring arm 160 can also be pivotally coupled to a first end 209 of the guide body 164. According to the illustrated embodiment, the guide body 164 includes a base 210 and a guide rod 212, the base 210 being generally positioned around at least the first end 209 of the guide body 164, and the guide rod 212 generally extending from the base 210. The guide rod 212 can have an outer size, such as, for example, a diameter or width, that can accommodate placement of the biasing element 166, such as, for example, a spring, about, or around, at least a portion of the guide rod 212. For example, an inner size, such as, for example, an inner diameter, of the biasing element 166 can be sized relative to a corresponding outer size of the guide rod 212 such that the biasing element 166 can be positioned about or over, as well as capable of being generally linearly displaced along, at least a portion of the guide rod 212. Additionally, the base 210 can have a size, such as, for example, a width, that is at least as large as, if not larger than, the inner diameter of the biasing element 166 such that a wall of the base 210 that is adjacent to the biasing element 166 provides a first shoulder 214 that can support the biasing element 166 and/or provide interference to at least assist in retaining the biasing element 166 on the guide rod 212. Further, the first shoulder 214, as well as a portion of the main bracket 170 can be positioned to at least compress or charge the biasing element 166 such that, when the biasing element 166 is discharged, the biasing element 166 can provide a force used to displace the pushrod to a position that closes an open current interrupter 102, as discussed below.

According to the illustrated embodiment, a portion of the guide body 164 that is generally approximate to a second end 216 of the guide body 164 can be sized to accommodate at least a portion of the guide body 164 being slidingly coupled to the main bracket 170. Further, according to the illustrated embodiment, the main bracket 170 includes a bracket body 218 and a pair of sidewalls 220. The bracket body 218 can generally extend in the interior region 150 of the closing mechanism 108 at least a portion of the distance between the inner surfaces 148 of the first and second closer brackets 136*a*, 136*b*. Each sidewall 220 of the main bracket 170 can include an arm 222 that extends from the interior region 150 of the closing mechanism 108 and through an aperture 224 in the sidewall 138 such that the arm 222 can be coupled to the guide body 164. The aperture 224 in the sidewall 138 can be sized to accommodate displacement of the main bracket 170 that is associated with the pushrod 106 being displaced to a position that closes the opened current interrupter 102. According to the illustrated embodiment, the arm 222 includes an orifice 226 that receives slideable placement of at least a portion of the guide rod 212. Further, similar to the base 210, the arm 222 can have a size, such as, for example, a width, that is at least as large as, if not larger than, the inner diameter of the biasing element 166 such that that arm 222 provides a second shoulder 228 that provides interference for at least assisting in retaining the biasing element 166 on the guide rod 212. When charged, the biasing element 166 can be compressed or otherwise charged between the first shoulder 214 of the guide body 164 and the second shoulder 228 of the arm 222. Additionally, as discussed below, rotational displacement of the guide body 164 can facilitate rotational displacement of the main bracket 170, as rotation of the guide rod 212 can exert a force against at least a portion of the arm 222 at or around the orifice 226 that can translate a rotational force to the main bracket 170.

Figure 8:
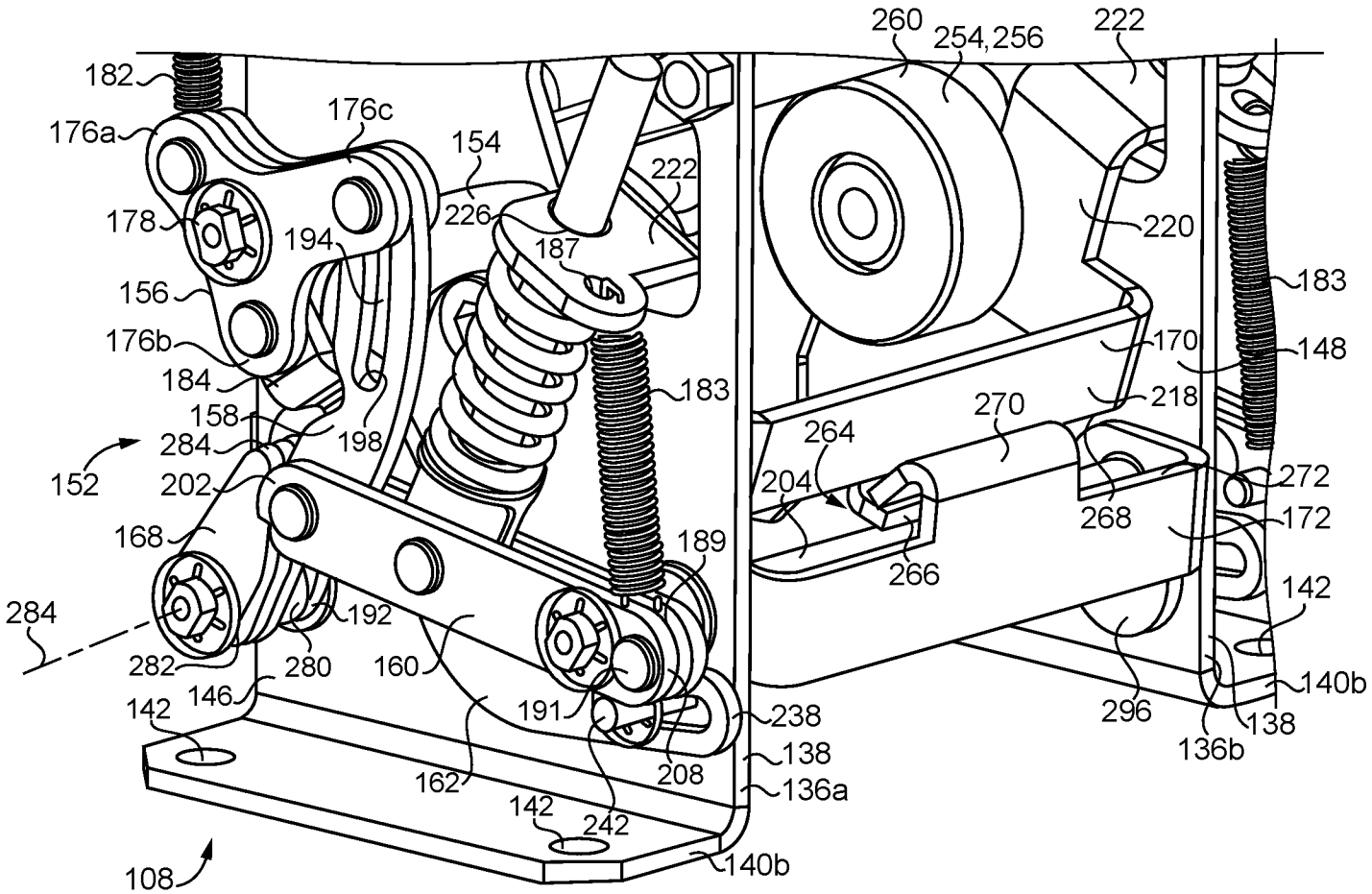
FIG. 8 illustrates a side perspective view of a lower portion of an exemplary closing mechanism.

As shown by at least FIG. 8, the main bracket 170 can be coupled to the spring arm 160 by a secondary biasing element 183. According to the illustrated embodiment, a first end 185 of the secondary mechanical biasing element 183 can extend through a portion of an opening 187 in the arm 222 of the sidewall 220 of the main bracket 170 and relatively securely engage a surface of the arm 222. A second end 189 of the secondary mechanical biasing element 183 can be coupled to another portion of the linkage system 152, such as, for example, a portion of a pin 191 that is coupled to the spring arm 160 in the general vicinity of the second end 208 of the spring arm 160. Further, according to the illustrated embodiment, the secondary mechanical biasing element 183, such as, for example, a spring, can provide a generally downward biasing force that biases at least the arm 222 of the main bracket 170 toward the spring arm 160, and moreover, seeks to at least attempt to provide a generally downward force against the arm 222 that can, after the closing mechanism 108 has been discharged, at least assist in displacing the main bracket 170 and components coupled thereto to a location(s) that prevents or minimizes the closing mechanism 108 from interfering with displacement of the pushrod 106 that may be associated with operation of the electromagnetic actuator 104, as discussed below.

Figure 6:
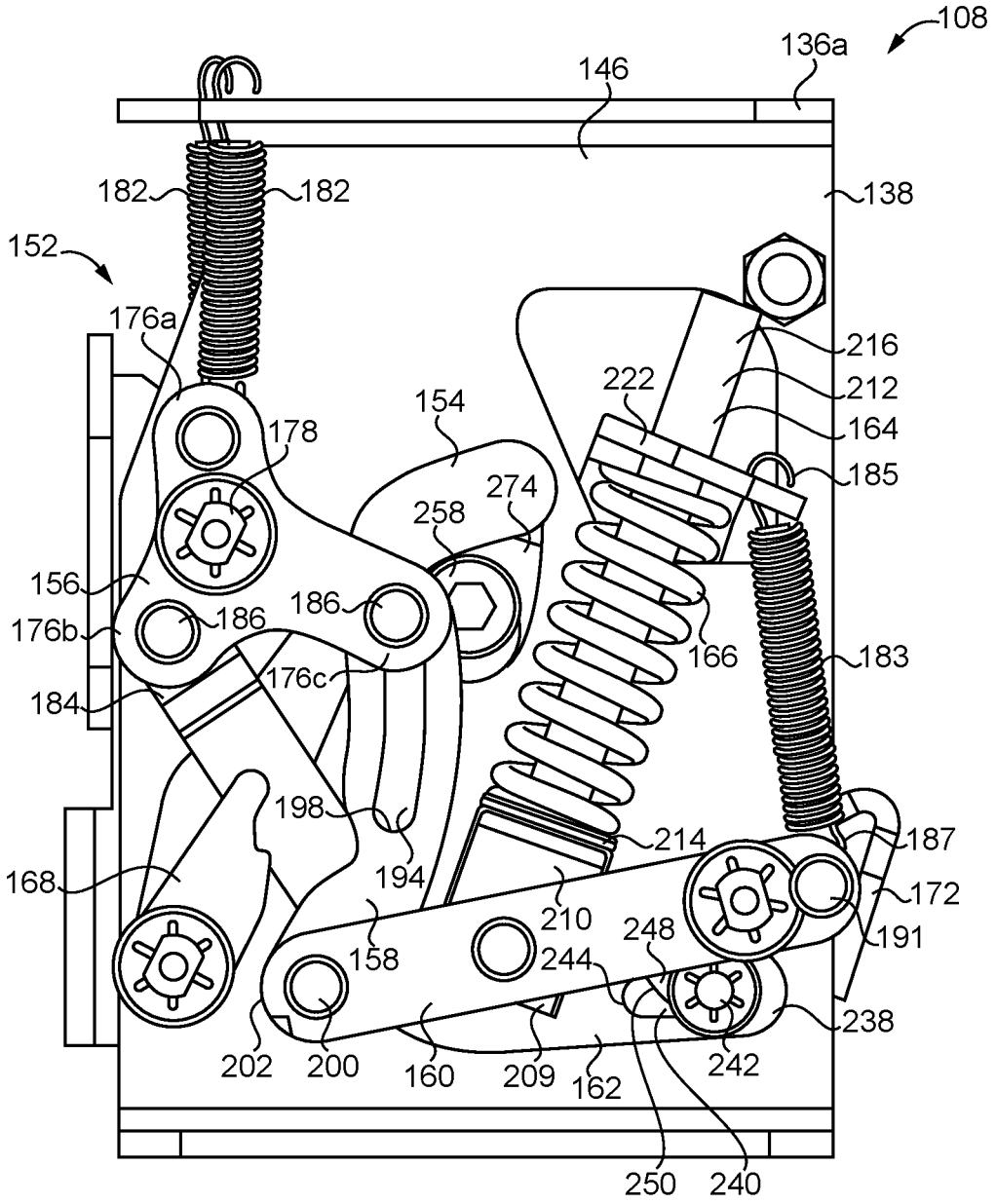
FIG. 6 illustrates a side view of a portion of an exemplary closing mechanism in a discharged state.

As previously discussed, the second leg 176*b* of the driving fork 156 can be pivotally coupled to a first end 184 of the release link 162. As shown in at least FIG. 7, according to the illustrated embodiment, a first portion 230 of the release link 162 can extend along a first axis 232, while a second portion 234 of the release link 162 extends along a second axis 236, the first and second axes 232, 236 generally intersecting to form an obtuse angle. A second end 238 of the release link 162 can include a generally elongated release slot 240 that is sized to receive insertion of a release pin 242 that is coupled to the release bracket 172. As shown in at least FIGS. 6 and 7, the release slot 240 can extend from a first end 244 to a second end 246. Further, the release pin 242 can be positioned in an elongated bracket slot 250 in the closer bracket 136*a*, 136*b* that extends between a first end 252 and a second end 254, as shown, for example, in FIGS. 6 and 7. As the driving fork 156 is rotated in the first, counterclockwise direction relative to the orientation of the linkage system 152 shown in FIG. 2B, the release link 162 is displaced such that the second end 246 of the elongated release slot 240 can contact the release pin 242 and generally linearly displace the release pin 242 toward the first end 250 of the elongated bracket slot 248. Such displacement of the release pin 242 can facilitate rotation of the release bracket 172 about the release bracket shaft 204 in a second, clockwise direction such that the release bracket 172 is displaced from a latch position to an unlatched position in which the release bracket 172 disengaged from a locking engagement with the main bracket 170, as discussed below.

According to the illustrated embodiment, the release bracket 172 includes sidewalls 292 positioned on opposing sides of a body portion 294 of the release bracket 172. Further, the sidewalls 292 can include apertures through which the release bracket shaft 204 extends, the release bracket 172 being rotatable about the release bracket shaft 204. Additionally, as shown by at least FIGS. 2A and 8, according to the illustrated embodiment, the sidewall 292 can include a leg portion 296 that can extend from each sidewall 292, a portion of each leg portion 296 being positioned within the interior region 150 of the closing mechanism 108. According to the illustrated embodiment, a leg portion 296 is positioned generally adjacent to inner surface 148 of the sidewall 138 of each closer bracket 136*a*, 136*b*. Additionally, each leg portion 296 can include, or be coupled to, the release pin 242 such that displacement of the release pin 242 about at least a portion of the elongated bracket slot 248 can cause rotation of the release bracket 172 about the release bracket shaft 204.

Figure 9A:
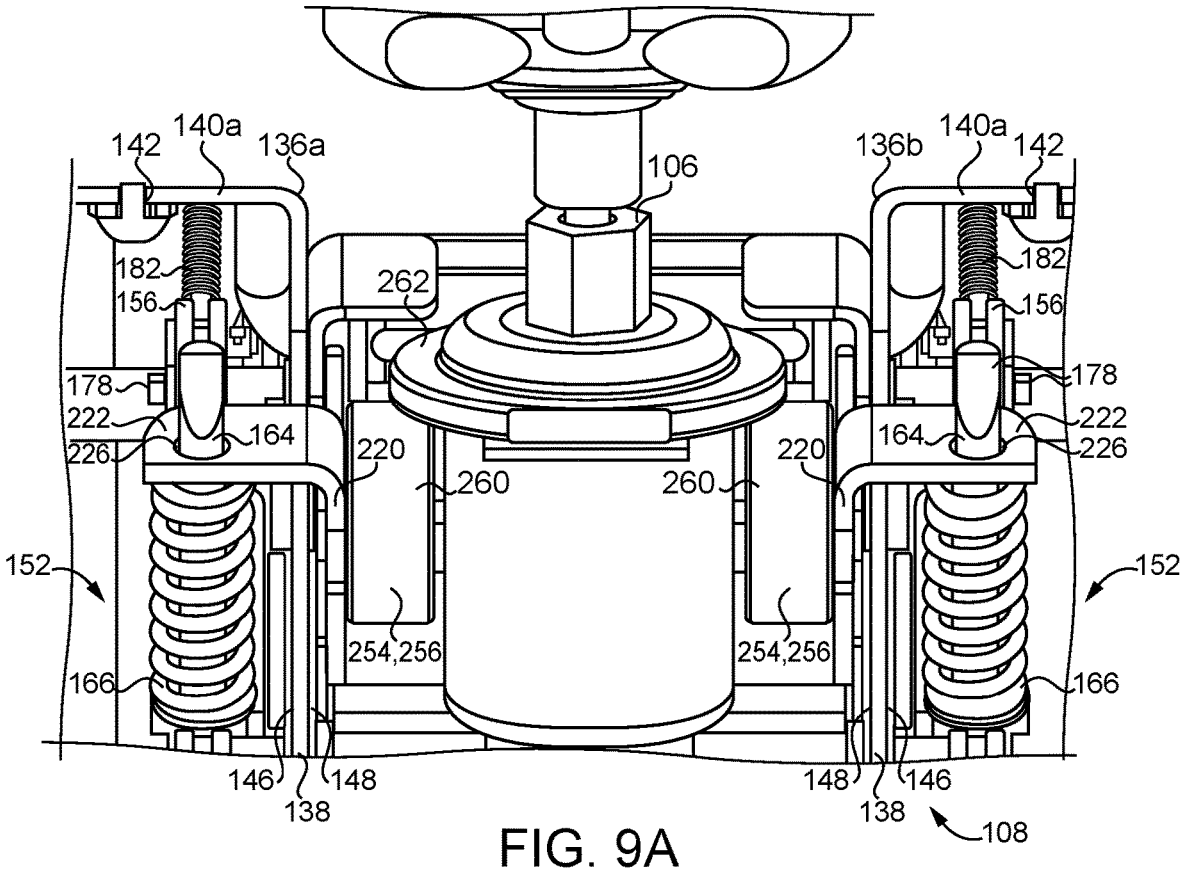
FIG. 9A illustrates a front view of an upper portion of an exemplary closing mechanism in an open, disengaged position relative to at least a pushrod of a recloser.
Figure 9B:
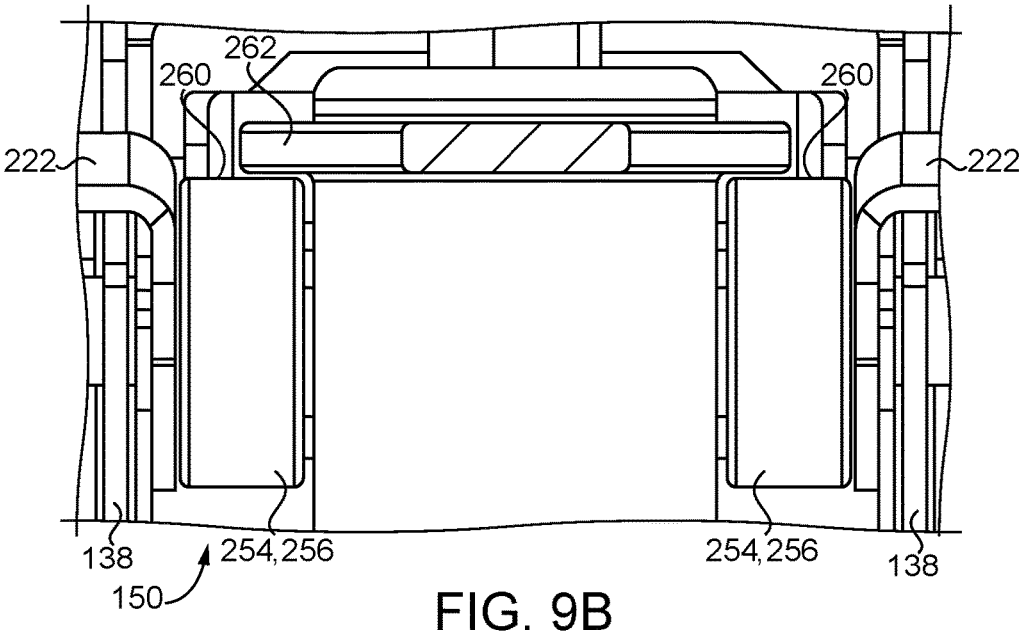
FIG. 9B illustrates a cross sectional front view of an upper portion of an exemplary closing mechanism in a closed, engaged position relative to at least a pushrod of a recloser.
Figure 10:
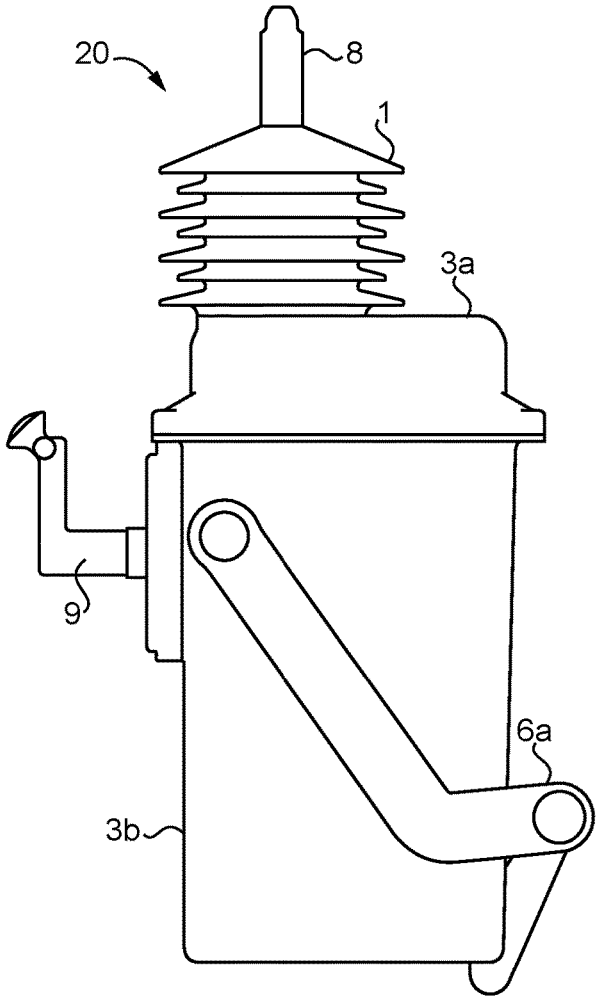
FIGS. 10-12 illustrates a side view, a first a partial cutaway side view and a second partial cutaway side view of an exemplary recloser, respectively.
Figure 11:
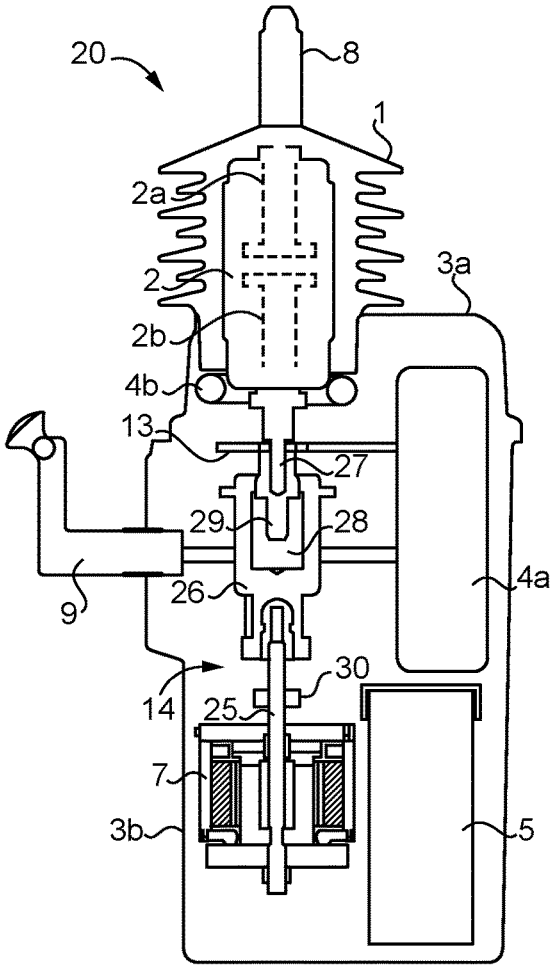
Figure 12:
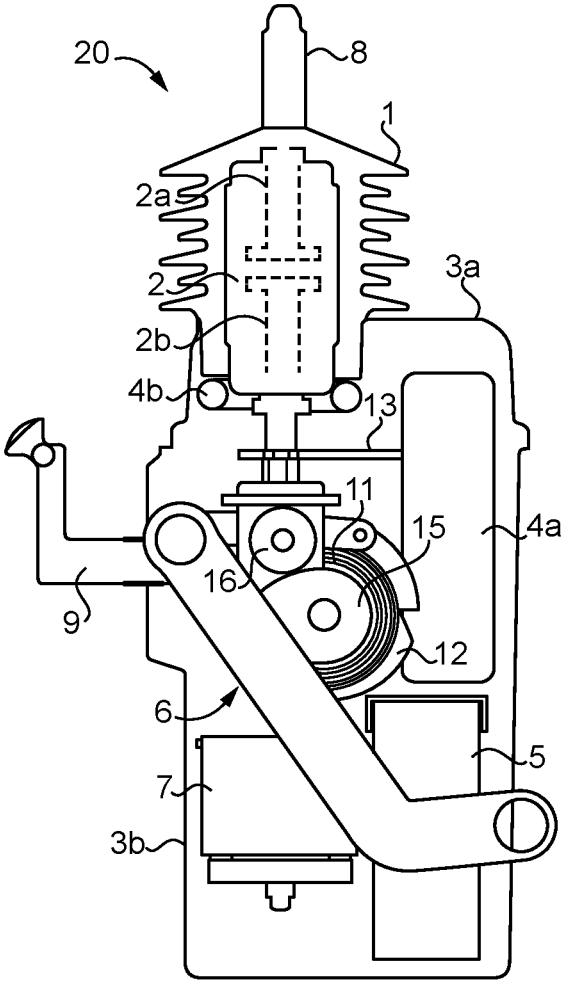
Figure 13:
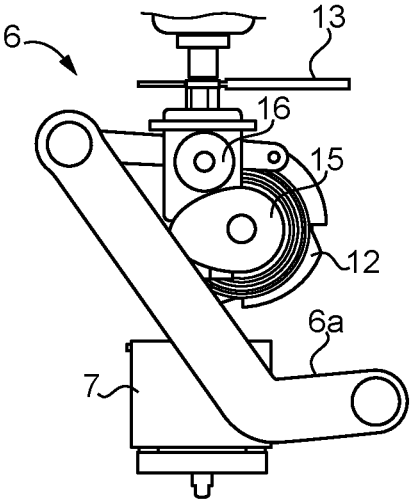
FIG. 13 illustrates a side view of a mechanical opening/closing mechanism actuator of the recloser of FIGS. 10-12.

At least a portion of the linkage system 152 is coupled to a closer body 254 that is configured to selectively, via operation of the closing mechanism 108, physically contact and displace the pushrod 106 in manner that facilitates the closing of an open current interrupter 102. According to such an embodiment, when activated, the linkage system 152 can trigger the closer body 254 to be displaced from a first position, as shown in at least FIGS. 4 and 9A, to a second position, as shown for example, in FIG. 9B, as well as release stored mechanical energy, such that the closer body 254 contacts the pushrod 106 in a manner that displaces the pushrod 106 to a position that can facilitate closing of the open current interrupter 102 as the closer body 254 is displaced to the second position. As discussed below, such displacement of the main bracket 170 and closer body 254, as well as the associated force to relatively rapidly displace the pushrod 106, can be provided, at least in part, by activation or discharging of the mechanical biasing element 166, and, moreover, provided by a force(s) at least associated with the mechanical biasing element 166 transitioning from a compressed state to a decompressed state.

The closer body 254 can have a variety of different shapes and configurations. For example, according to certain embodiments, the closer body 254 can be a projection that extends from, or is otherwise coupled to, the main bracket 170. According to the illustrated embodiment, the closer body 254 is a roller 256 that is coupled to the sidewall(s) 220 of the main bracket 170, such as, for example, by a closer fastener 258, including, for example, a screw, pin, or bolt, among other fasteners. According to the illustrated embodiment, as the closer body 254 is coupled to the main bracket 170, the displacement of the closer body 254 from the first position to the second position can proceed along a curved or arced path of travel that is generally similar to the rotational movement of the main bracket 170. Thus, in an effort to at least minimize the degree of impact or jolt associated with the closer body 254 being delivered into physical contact with the pushrod 106, at least an outer the portion of the closer body 254, namely a contact surface 260 of the closer body 254, that can come into contact with the pushrod 106 via operation of the closing mechanism 108, and which provides a location for the transmission of the displacement force to the pushrod 106, can have a curved or arced shape. Thus, for example, according to embodiments in which the closer body 254 is a roller, the contact surface 260 can be a portion of the outer circular surface of the roller 256.

According to the illustrated embodiment, when being moved to the second position, the contact surface 260 of the closer body 254 can selectively engage one or more protrusions or projections of the pushrod 106. For example, as shown by at least FIG. 9B, according to the illustrated embodiment, the pushrod 106 can include a flange 262 that is generally orthogonal to the central longitudinal axis of the pushrod 106, and, moreover, is generally orthogonal to the direction of travel of the pushrod 106 in the first and second directions, as indicated by directions "D1" and "D2" in FIGS. 5B and 5A, respectively. According to the illustrated embodiment, the flange 262 can outwardly extend away from the central longitudinal axis of the pushrod 106 by a distance that provides a clearance away from other relatively adjacent portions of the pushrod 106 such that the closer body 254 can be positioned to be operably moved into contact with the flange 262 without contacting other portions of the pushrod 106.

The main bracket 170 and the release bracket 172 can each include, or be coupled to, portions of a main latch 264 that is configured to selectively lockingly engage the main bracket 170 to the release bracket 172. For example, according to the illustrated embodiment, an upper latch member or portion 266 of the main latch 264 that extends from a lower wall 268 of the bracket body 218 of the main bracket 170 can matingly engage a lower latch member or portion 270 of the main latch 264 that extends from an upper wall 272 of the release bracket 172. According to the illustrated embodiment, the upper and lower latch members 266, 270 are curved shaped projections, extensions, hooks, and/or arms, among other configurations or components, that can lockingly engage each other when the closing mechanism 108 is at least in a charged state or condition. As shown in at least FIG. 8, according to certain embodiments, inner surfaces of the upper and lower latch members 266, 270 can lockingly engage each other. Such locking engagement can retain the main bracket 170 at a position associated with the closer body 254 being at the above-discussed first position, as shown, for example, by FIG. 4. However, as discussed below, at least when the closer body 254 is to be released from the first position, and, moreover, when the closer body 254 is to move to the second position so as to facilitate displacement of the pushrod 106 to a position that closes the opened current interrupter 102, the release bracket 172 can be displaced away from the main bracket 170 in a manner that separates the lower latch member 270 from the upper latch member 266. For example, with respect to at least the orientation depicted in FIG. 2B, as the release bracket 172 is rotated in the first, counterclockwise direction about the release bracket shaft 204, the lower latch member 270 can be displaced to a position that no longer engages the upper latch member 266, thereby unlocking the main latch 264. With the main latch 264 unlocked, the lower latch member 270 is not positioned to prevent the operable displacement of the main bracket 170, and the main bracket 170 can be rotatably displaced such that the closer body 254 can be displaced to the second position, as shown, for example, by FIG. 9B.

As the main bracket 170 is rotatably displaced such that the closer body 254 can be displaced to the second position, the closer fastener 258 or other projection or protrusion extending from or otherwise coupled to the main bracket 170 is similarly rotatably displaced. As shown by at least FIGS. 2B, 6, and 7, according to the illustrated embodiment the closer fastener 258 extends through an aperture 274 in the sidewall 138 of the closer bracket 136*a*, 136*b*. Moreover, the aperture 274 can be sized to accommodate movement of the closer fastener 258 associated with the displacement of the main bracket 170. Further, as the closer fastener 258 is displaced via displacement of the main bracket 170, the closer fastener 258 can slidingly engage the secondary latch lever 154 such that the closer fastener 258 exerts a force against the secondary latch lever 154, such as, for example, along or around a portion of the secondary latch lever 154, in the general vicinity of the first end 276 of the secondary latch lever 154. As the closer fastener 258 is moved with the displacement of the main bracket 170, the force exerted by the closer fastener 258 on the secondary latch lever 154 can cause the secondary latch lever 154 to rotate. Moreover, a second end 278 of the secondary latch lever 154 can be securely coupled to a lever spindle 280 that is coupled to the sidewall 138 of the adjacent closer bracket 136*a*, 136*b* and/or the close latch 168. Accordingly, the displacement of the closer fastener 258 can, via at least engagement of the closer fastener 258 with the latch lever 154, cause the secondary latch lever 154 to rotate generally about a central longitudinal axis 284 (FIG. 8) of the lever spindle 280, and cause similar rotational displacement of at least the lever spindle 280.

The lever spindle 280 can also be coupled to a second end 282 (FIG. 8) of the close latch 168 such that rotation of the lever spindle 280 can facilitate rotatable displacement of the close latch 168 generally in the same direction. According to the illustrated embodiment, a first end 284 of the close latch 168 can include a groove or recess 286 having a shape that can facilitate the close latch 168 selectively lockingly engaging at least a portion of the first end 202 of the spring arm 160. Further, according to certain embodiments, in an effort to facilitate the locking engagement between the close latch 168 and the spring arm 160, the first end 202 of the spring arm 160 can also include a groove or recess 288 (FIG. 2B) and/or a corresponding projection or protrusion 290 (FIG. 3B) that provides the spring arm 160 with a shape that can enhance the selective locking engagement between the close latch 168 and the spring arm 160. Additionally, according to certain embodiments, a mechanical biasing element, such as, for example a torsion spring, among other biasing elements, can be operably coupled to the close latch 68 in a manner that biases the close latch 168 to a position at which the close latch 168 can lockingly engage the spring arm 160. For example, according to certain embodiments, a torsion spring can be coupled to, or otherwise in operable engagement with, the lever spindle 280 such that the torsion spring provides a force that seeks to bias the close latch 168 to a position that facilitates locking engagement of the close latch 168 with the spring arm 160. For example, with respect to the orientation of the linkage system 152 depicted in FIG. 2B, the torsion spring can provide a force that generally biases the close latch 168 in the clockwise, or second, rotational direction, as indicated by the rotational direction "$R_2$" in FIG. 2B.

Figure 7:
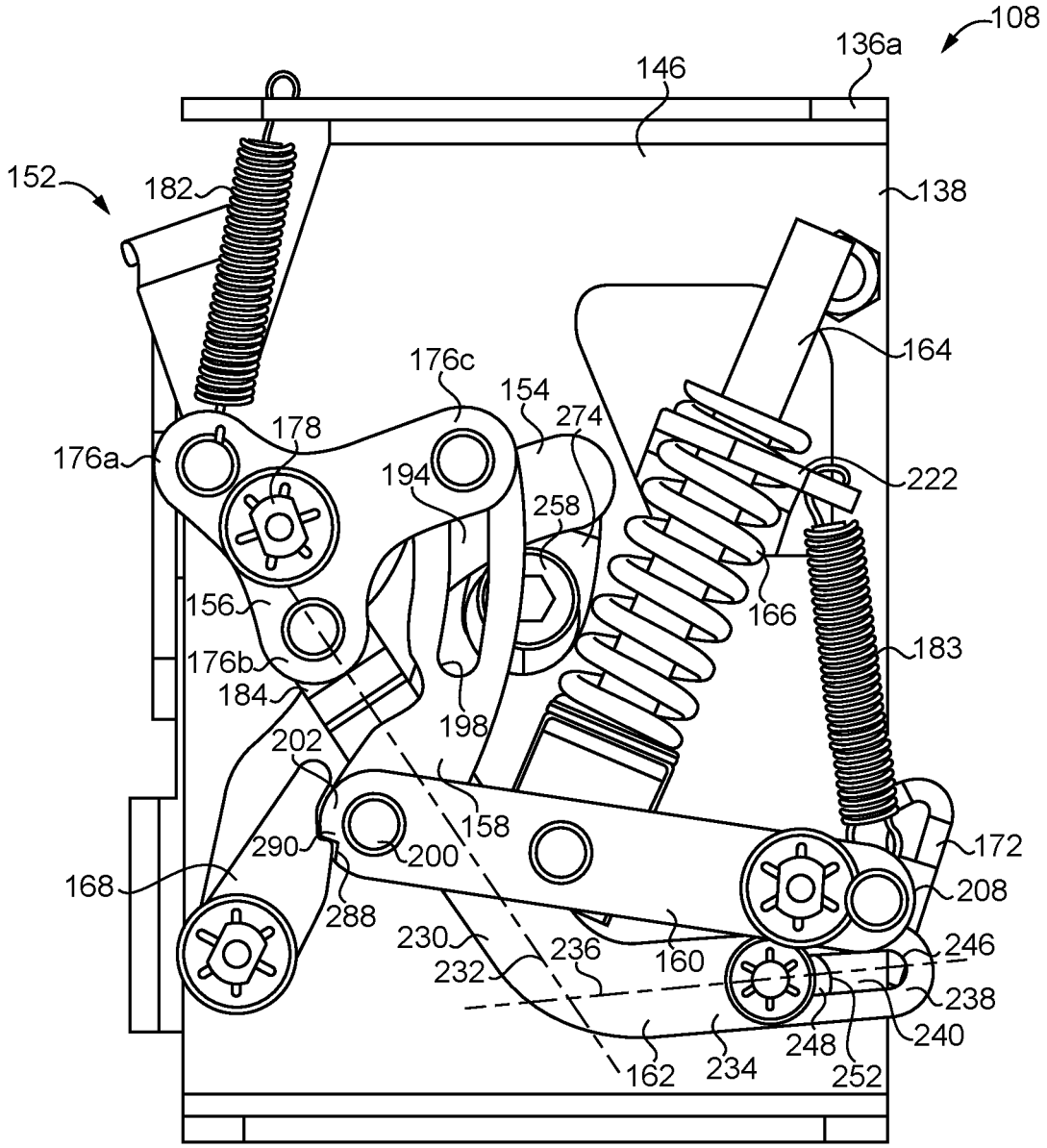
FIG. 7 illustrates a side view of the portion of the exemplary closing mechanism depicted in FIG. 6 in a charged state.

As discussed below, and as shown by at least FIG. 7, when the closing mechanism 108 is in a charged state, a portion of the spring arm 160 can be lockingly engaged with the close latch 168. For example, as shown in FIG. 7, when the closing mechanism 108 is in a charged state, the close latch 168 may be at an angular orientation such that close latch 168 engages the spring 160 in a manner that prevents the spring arm 160 from rotating in the counterclockwise direction. However, as illustrated by at least FIG. 6, upon rotation of the close latch 168 in the counterclockwise direction, such as, for example, upon rotation of the lever spindle 280 via displacement of the secondary latch lever 154 when the closing mechanism 108 is changing from the charged state to the discharged state, the close latch 168 may disengage from the locking engagement with the spring arm 160, and thus the spring arm 160 can, at least with respect to the orientation of the linkage system 152 depicted in FIG. 2B, be rotated in the first, counterclockwise direction.

According to certain embodiments, installation of the recloser 100 can include, at least initially, opening, if not already opened, the current interrupter 102, and attaching the driver 180 to the driven hub 178 of one or more linkage systems 152. As discussed above and illustrated in at least FIGS. 1 and 4, according to certain embodiments the recloser 100 includes two linkage systems 152. Thus, while for at least purposes of discussion, one linkage system 152 may be discussed below and illustrated in certain figures, such discussions are also applicable to the other linkage system(s) 152 of the recloser 100.

With current interrupter 102 open and the driver 180 coupled to the driven hub 178 of one or more linkage systems 152, the driver 180 can be lifted and/or rotated such that the driving fork 156 is rotated in a first rotational direction (as indicated by "$R_1$" in FIG. 2B), and the third leg 176*c* of the driving fork 156 thereby lifts the link guide 158. For example, with respect to the orientation of the linkage system 152 depicted in FIG. 2B, rotational displacement of the driver 180 in the first, counterclockwise or rotational direction with a force sufficient to overcome at least the biasing force of the secondary mechanical biasing element 182 that is coupled to the driving fork 156, among other forces, can result in the driving fork 156 similarly being rotated in the first rotational direction. As the driving fork 156 is rotated in the first rotational direction, the guide pin 186 that is coupled to the third leg 176*c* of the driving fork 156 exerts a force against the link guide 158 at or around the first slot end 196 of the elongated guide slot 194 to lift or otherwise displace the link guide 158 generally in the direction of the first attachment flange 140*a*.

As previously discussed, the link guide 158 can be rotatably coupled to a first end 202 of the spring arm 160. Accordingly, such displacement of the link guide 158 in the first rotational direction via operation of the driver 180 can, with respect to the orientation depicted in FIG. 2B, facilitate the rotational displacement of the spring arm 160 in the second clockwise or rotational direction (as indicated by "$R_2$" in FIG. 2B) about the release bracket shaft 204, the first and second rotational directions being opposite of each other.

As the spring arm 160 is rotated about the release bracket shaft 204 (FIG. 3A) in the second rotation direction, the guide body 164, which, again, can be coupled to the spring arm 160, can be displaced in a direction generally toward the arm 222 of the main bracket 170 such that a linear distance between the base 210 of the guide body 162 and the arm 222 decreases. Further, as the linear distance between the base 210 of the guide body 162 and the arm 222 decreases, the mechanical biasing element 166, such as, for example, a spring, positioned about the guide rod 212 can be compressed and/or further compressed between the opposing first and second shoulders 214, 228.

Additionally, as the driven hub 178 is rotated in the first rotational direction, the spring arm 160 can be lifted to a position at which the spring arm 160 can be lockingly engage with, or otherwise be held in a lifted position by, the close latch 168. For example, as previously discussed, according to certain embodiments, rotation of the spring arm 160 can result in the spring arm 160 being at a position at which a protrusion 290 and/or area of the spring arm 160 adjacent to the recess 288 in the spring arm 288 can lockingly engage a generally mating portion of the close latch 168, such as, for example, a portion of the close latch 168 that is adjacent to the recess 288 in the close latch 168.

Additionally, rotation of the driving fork 156 in the first rotational direction can facilitate the second leg 176*b*, which, as previously discussed is coupled to the release link 162, exerting a force against the release link 162 that can result in a portion of the release link 162 at or around a second end 238 of an elongated release slot 240 of the release link 162 coming into contact with the release pin 242 that is coupled to the release bracket 172. As also previously discussed, with at least a portion of the release link 162 at or around the second end 238 of the elongated release slot 240, the continued displacement of the driving fork 156 in the first rotational direction can result in the release pin 242 being displaced toward the first end 250 of the elongated bracket slot 248 in the closer brackets 136*a*, 136*b*, which can facilitate rotation of the release bracket 172 about the release bracket shaft 204 in the first rotational direction. Moreover, such displacement of the release pin 242, and thus the release bracket 172, can result in the lower latch member 270 being rotatably displaced to a position at which, in association with the upper latch member 266 of the main bracket 170, facilities the locking the main latch 264, as shown, for example, by at least FIGS. 1 and 4. Again, with the main latch 264 locked, the main bracket 170 can be prevented from being rotatably displaced to a position at which the closer body(ies) 254 engage the pushrod 106, and, moreover, the flange 262, in a manner that could facilitate displaced of the pushrod in a manner that may close the open current interrupter 102.

Accordingly, with the main bracket 170 lockingly engaged with the release bracket 172 via at least the main latch 264, and the mechanical biasing element 166 being held in a compressed or charged state, the linkage system 152 and/or the closing mechanism 108 is in the charged state. Further, when the linkage system 152 and/or the closing mechanism 108 is in the charged state, the closer body 254 can be at a first position, as shown for example by at least FIG. 4. More specifically, with the closing mechanism 108 in the charged state, the closer body 254 is at a first position at which the closer is generally in non-engagement with the pushrod 106, and moreover, is not in engagement with the flange 262 of the pushrod 106.

With the closing mechanism 108 in the charged state, the driver 180 can be operated to facilitate the linkage system(s) 152 discharging the mechanical biasing element 166 such that the closer body 254 can be displaced into engagement with, as well as facilitate the displacement of, the pushrod 106 so that the pushrod 106 can be linearly displaced to a position that at least temporarily closes the current interrupter 102. Moreover, according to the illustrated embodiment, the driver 180 can be pulled or otherwise rotatably displaced in the second direction, which can be translated to, via the driver 180 being coupled to the driven hub 182, the driving fork 156 being rotatably displaced in the second rotational direction.

According to the illustrated embodiment, with the closing mechanism 108 in the charge state, and the driving fork 156, and at least the associated third leg 176*c*, being displaced in the second rotational direction, the guide pin 186 that is coupled to the third leg 176*c* can be displaced away from the first slot end 196 of the elongated guide slot 194. Further, according to certain embodiments, as the driving fork 156 is displaced in the second rotational direction and the guide pin 186 is traveling toward the second slot end 198 of the guide slot 194, the release link 162, via the coupling of the release link 162 to the second leg 176*b*, is displaced in direction that facilitates a portion of the release link 162 at or around second end 246 of the elongated release slot 240 contacting the release pin 242. Moreover, as the driving fork 156 continues to be rotatably displaced in the second rotational direction, a portion of the release link 162 at or around the second end 246 of the elongated release slot 240 of the release link 162 can exert a force against the release pin 242 that displaces the release pin 242 toward the first end 250 of the elongated bracket slot 248 in the closer bracket 136*a*, 136*b*. Such displaced of release pin 242 by the release link 162 can facilitate rotational displacement of the release bracket 172 in the second rotational direction.

As the release bracket 172 is rotated in the second rotational direction in response to at least displacement of the release pin 242, the lower latch member 270 that extends from the release bracket 172 can be moved away from the upper latch member 266 that extends from the main bracket 170 so that the main latch 264 is unlocked. Further, according to at least certain embodiments, at or around the time the main latch 264 is unlocked, the guide pin 186 can reach a position at or generally around the second slot end 198 of the guide slot 194 in the link guide 158.

With the main latch 264 unlocked, the main latch 264 may no longer prohibit operable rotational displacement of the main bracket 170. Thus, according to the illustrated embodiment, at or around the time that the main latch 264 is unlocked, the mechanical biasing element 166 can be discharged, and the main bracket 170 can begin to be relatively rapidly displaced via a force(s) provided by at least the release of the stored energy of the previously charged mechanical biasing element 166. Accordingly, as the main bracket 170 is displaced, the closer body 254 is displaced from the first position, at which the closer body 254 is not engaged with the pushrod 106, to an intermediate position at which the closer body 254 at least comes into contact with the pushrod 106. As previously discussed, according to certain embodiments, such engagement or contact can occur between the contact surface(s) 260 of the closer body(ies) 254 and a generally outwardly extending flange 262 of the pushrod 106. As the main bracket 170 continues to be displaced to the above-discussed second position of the closer body(ies) 254, the engagement and/or contact between the closer body(ies) 254 and the pushrod 106 can facilitate the displacement of the pushrod 106 to positioned that facilitates the at least temporary closing of the current interrupter 102. For example, according to certain embodiments, when the closer body 254 has reached the second position, as shown for example in FIG. 9B, the pushrod 106 may have been displaced to a position that results in the moveable contact 112 being electrically coupled to the fixed contact 110 such that the current interrupter 102 is closed. Accordingly, rather than being closed by an electromagnet actuator, the discharging of the charged closing mechanism 108 can result in a mechanical closing of a current interrupter 102 via the application of released stored energy from the closing mechanism 108 to displace an otherwise magnetically displaceable pushrod 106.

With the current interrupter 102 being closed via the operation of the closing mechanism 108, current may again flow through the recloser 100. Further, such a supply of primary power through the recloser 100 may also provide power that can be stored by the electronics of the recloser 100, including, for example, the electromagnetic actuator 104, for subsequent operation of the electromagnetic actuator 104. However, in at least certain situations, such as, for example, situations in which the fault current that caused the initial opening of the recloser 100 remaining unresolved, the current interrupter 100 may, in a relatively short time period after being closed by the closing mechanism 108, be reopened by subsequent operation of the electromagnetic actuator 104. Accordingly, the closing mechanism 108 can also be configured to, after discharging of the closing mechanism 108 and associated displacement of the closer body(ies) 254 to the second position, relatively rapidly displace at least the closer body 254 and/or the main bracket 170, among other portions of the closing mechanism 108, to a position(s) such that the closing mechanism 108 does not interfere with any subsequent re-opening of the current interrupter 102 by operation of the electromagnetic actuator 104.

Therefore, as previously discussed, as the main bracket 170 is being displaced during discharging of the closing mechanism 108, the closer fastener 258 is also displaced such that a sliding engagement between the closer fastener 258 and the secondary release lever 154 facilitates the rotational displacement of the secondary latch lever 154 in the first rotational direction. As the secondary latch lever 154 is coupled to the lever spindle 280, which is also coupled to the close latch 168, such rotation of the secondary latch lever 154 is translated, via the lever spindle 280, to the close latch 168. Accordingly, such rotation of the secondary latch lever 154 via engagement with the closer fastener 258 results in the close latch 168 also being rotatably displaced in the second rotational direction.

As the close latch 168 is rotated in the second rotational direction, the close latch 168 is disengaged from the locking engagement with the spring arm 160. Further, as the spring arm 160 is coupled to the guide body 164, with the spring arm 160 unlatched from the close latch 168, the spring arm 160 is able to, with respect to the linkage system 152 orientation depicted in FIG. 2B, be rotatably displaced in the first rotational direction. According to certain embodiments, such rotation of the spring arm 160 can be added, for example, at least in part, by the biasing force provided by the mechanical biasing element 166, among other forces. Further, such displacement of at least the spring arm 160 can increase the linear distance between the arm 222 of the main bracket 170 and the base 210 of the guide body 164, and, moreover, the distance between the associated first and second shoulders 214, 228, thereby further relieving the pressure or force being exerted by the mechanical biasing element 166.

According to certain embodiments, the timing of the release of the spring arm 160 from locking engagement with the close latch 168 can generally coincide with, or be shortly after, the closer body 254 reaching, via discharging of at least the mechanical biasing element 166, the second position and/or the pushrod 106, via operation of the closing mechanism 108, closing the current interrupter 102. Accordingly, with the force or pressure of the mechanical biasing element 166 being reduced and/or relieved and the pushrod 106 positioned for the current interrupter to be, or have been, closed, the secondary mechanical biasing element(s) 183 that is/are coupled to main bracket 170 and another portion of the closing mechanism 108 can exert a force that displaces at least the main bracket 170 to a position that can prevent or minimize the ability of the closer body(ies) 254 to interfere with the subsequent displacement, if any, of the pushrod 106 that may be associated with the electromagnetic actuator 104 re-opening the current interrupter 102. For example, according to the illustrated embodiment, the secondary mechanical biasing element(s) 183 that is/are coupled to both the arm 222 of the main bracket 170 and a portion of the pin can, at or around the timing of the closing of the current interrupter 102 via operation of the closing mechanism 108 and associated mechanical displacement of the pushrod 106, exert a force on the main bracket 170 that displaces the closer body(ies) 254 away from the second position of the closer body(ies) 254 and toward, or to, the first position of the closer body(ies) 254. The closing mechanism 108 may then be at the discharged state or condition, as show, for example, in at least FIGS. 2B and 6.

With reference to FIGS. 10-14 there are illustrated certain aspects of an exemplary recloser 20 which includes an upper housing 1 containing a vacuum interrupter 2 and a first terminal 8. The recloser 20 also includes a lower housing 3 containing a power harvesting current transformer 4*a*, a Rogowski coil 4*b*, a control board 5, a mechanical opening/closing mechanism 6 which includes a handle 6*a*, an electromagnetic actuator 7 and a second terminal 9. Mechanical opening/closing mechanism 6 provides functionality analogous to that of mechanism 108 described above. It shall be appreciated that in some embodiments mechanism 6 or its features can be provided in connection with the other features of the embodiments described as including mechanism 108. Likewise in some embodiments mechanism 108 or its features can be provided in connection with the other features of the embodiments described as including mechanism 6.

The vacuum interrupter 2 can be manually moved between a closed circuit position and an open circuit position by an operator. In the closed circuit position, the electrical contacts 2*a*, 2*b* within vacuum interrupter 2 contact one another to provide a closed circuit between terminal 8 and terminal 9. Moving handle 6*a* downward causes mechanical opening/closing mechanism 6 to mechanically move electromagnetic actuator 7 and vacuum interrupter 2 to the open circuit position thereby breaking the circuit between terminal 8 and terminal 9. In particular, the mechanical opening/closing mechanism 6 includes a cam 15 and a follower 16 that is mechanically coupled to a moveable rod 25 of electromagnetic actuator 7. Moving handle 6(*a*) downward causes the follower and the rod 25 of the electromagnetic actuator 7 to move downward. The actuator rod 25 is coupled to the vacuum interrupter 2 by a drivetrain 14 such that downward movement of the actuator rod 25 causes the vacuum interrupter 2 to open.

From the open circuit position, the handle 6*a* can be moved up and down repeatedly to operate a ratcheting mechanism 12 to wind a spring 11 within mechanical opening/closing mechanism 6. Once the spring is sufficiently wound, moving the handle 6*a* to its most upward position will cause opening/closing mechanism 6 to mechanically move electromagnetic actuator 7 and vacuum interrupter 2 to the closed circuit position. After a certain number of up and down ratcheting operations, the ratcheting mechanism 12 encounters an end feature which prevents further winding of the spring and only allows the handle 6*a* to be move upward. When the handle 6*a* is moved upward from this point, the spring is released to drive the cam 15 to move the follower 16 upward. In response, the follower drives the rod 25 of the electromagnetic actuator 7 upward. The upward motion of the actuator rod 25 is transferred to the vacuum interrupter 2 by the drivetrain 14 and causes the vacuum interrupter 2 to close.

Figure 14:
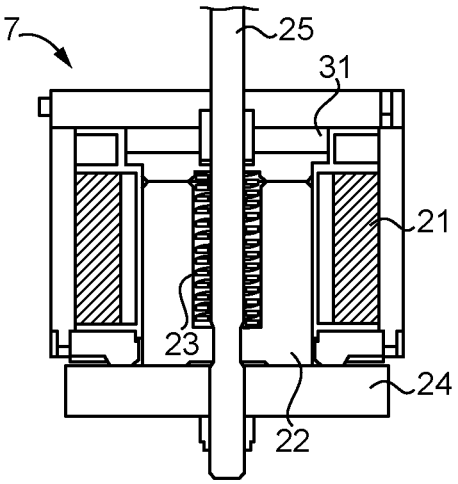
FIG. 14 illustrates a side view of an electromagnetic actuator of the recloser of FIGS. 10-12.

The vacuum interrupter 2 can also be opened and closed by electronic control of the electromagnetic actuator 7. As illustrated in FIG. 14, electromagnetic actuator 7 includes a single copper coil 21 which surrounds an armature member 22 that is biased downward by an open spring 23 and is coupled to and moves with an on cap 24 and an actuator rod 25. Control board 5 includes control circuitry which may comprise a control circuit including one or more control devices such as a microprocessor, microcontroller or ASIC, one or more memory devices storing instructions executable by the control circuit as well as additional discrete circuit elements such as power supplies and switching devices. Control board 5 can energize the copper coil 21 with a closing current to drive the armature member 22, on cap 24 and actuator rod 25 upward to a closed position. A magnet 31 is provided toward the top of the electromagnetic actuator opposite the top of the armature member 22. After the armature member 22 is driven upward it is maintained in the closed position by a holding force generated by the magnetic field of the magnet 31 even after the coil 21 is de-energized by ending the closing current.

From the closed position, control board 5 can energize the copper coil 21 with a de-magnetizing current to create a magnetic field opposing the holding force of the magnet. When this occurs the force of the open spring 23 exceeds the holding force and drives the armature member 22, on cap 24 and actuator rod 25 downward to the closed position. The de-magnetizing current may be provided to the coil 21 when the control board detects increased current output by Rogowski coil 4*b* which may indicate a fault. A number of fault detection techniques may be utilized including comparisons of current magnitude relative to a threshold, comparisons of rate of change of current magnitude relative to a threshold, and comparisons of other current characteristics such as frequency and phase.

The drivetrain 14 connecting the actuator rod 25 of the electromagnetic actuator 7 to the vacuum interrupter 2 includes an actuator rod 25. The actuator rod 25 is coupled with an insulating connector 26 by a threaded connection. The insulating connector 26 is coupled with a piston 29 which is retained in and moveable relative to the insulating connector 26 and is biased upward by a stack of Bellville washers 28. The piston 29 is connected to a stud 27 by a threaded connection. The stud 27 is connected to the moveable contact 2*b* of the vacuum interrupter 2 by a threaded connection. During assembly the piston 29 is threaded onto the end of the stud 27 and a flex conductor 13 is captured and retained in place between the piston 29 and the moveable contact 2*b* of the vacuum interrupter 2 by force provided by tightening the threaded connection between the piston 29 and the stud 27. The flex conductor 13 is also connected to the terminal 9.

Upward movement of the actuator rod 25 is transmitted via the drivetrain 14 to a moveable contact 2*b* of the vacuum interrupter 2. The moveable contact 2*b* is moved into contact with a stationary contact 2*a* of the vacuum interrupter 2 to provide a closed circuit. The travel distance of the actuator rod 25 can be adjusted by moving the position of the travel adjustment nut 30. The maximum upward position of the actuator rod 25 is limited by the armature member 22 coming into contact with the upper surface of the electromagnetic actuator 7. The maximum downward position of the actuator rod 25 is limited by the travel adjustment nut 30 coming into contact with the top surface of the electromagnetic actuator 7. By adjusting the position of the travel adjustment nut 30 along the actuator rod 25, the maximum downward position of the actuator rod 25 can be varied while the maximum upward position of the actuator rod 25 remains unchanged. By this adjustment the distance between the electrical contacts 2*a*, 2*b* when the vacuum interrupter 2 is in the open position can be varied.

The drivetrain 14 can be also configured to provide over travel or a wipe distance which will compress the Bellville washers 28 after the contacts of the vacuum interrupter 2 contact one another. This provides increased contact force between the contacts 2*a*, 2*b* of the vacuum interrupter 2. The compression of the Bellville washers 28 also creates a separation between the piston 29 and the insulating connector 26. During an opening event, the actuator rod 25 and insulating connector 26 will travel downward as the Bellville washers 28 decompresses. The insulating connector 26 will then come into contact with the piston 29 and the resulting contact force may contribute to breaking a weld which may exist between the contacts of the vacuum interrupter 2. The mechanical opening force of the spring is also selected to be of sufficient magnitude to break a weld which may exist between the contacts of the vacuum interrupter 2 even if no over travel or wipe distance is present.

The presence and amount of over travel or wipe distance can be adjusted. To make this adjustment, the insulating connector 26 is held stationary and the actuator rod 25 and on cap 24 are engaged by a tool and rotated. This causes the actuator rod 25 to thread into or out of the insulating connector 26 which decreases or increases the length of the drivetrain 14. By increasing the length of the drivetrain 14 the amount of over travel or wipe distance can be increased and vice-versa. It shall be appreciated that the insulating connector 26 is not rotated to adjust over travel or wipe distance and is maintained stationary during such adjustment in order to maintain the desired contact between the flex conductor 13 and the moveable contact 2*b* of the vacuum interrupter. The tightening force which results from threading the stud 27 of the drivetrain 14 into the moveable contact 2*b* of the vacuum interrupter 2 is preferably of sufficient magnitude to maintain the two components in a fixed relationship relative to one another. A second tool may also be used to engage the insulating connector while the actuator rod 25 and on cap 24 are rotated to provide further assurance that the stud 27 of the drivetrain 14 into the moveable contact 2*b* of the vacuum interrupter 2 are maintained in a fixed rotational relationship. A threadlocker such as a Loctite® may also be applied to the stud 27 threaded into the moveable contact 2*b* to resist relative rotation of these elements.

The recloser 20 also includes a second handle (not illustrated) which is used to select between two operating modes: a reclose mode in which the recloser 20 attempts to reclose the vacuum interrupter 2 a predetermined number of times after a fault and then remains open if the fault condition persists, and a non-reclose mode in which the recloser 20 remains open after a fault and does not attempt to reclose. Other operating modes of the recloser 20 are also contemplated.

Certain aspects of certain exemplary embodiments shall now be further described. A first exemplary embodiment is an apparatus including a vacuum interrupter that can be moved between a closed circuit position and an open circuit position by a mechanical actuator as well as an electromagnetic actuator. In certain forms the apparatus is structured as a recloser apparatus. In certain forms the mechanical actuator may include the features of any of the second through fifth exemplary embodiments.

A second exemplary embodiment is an apparatus comprising: a vacuum interrupter operatively coupled with first and second electrical power terminals configured to be coupled with a power distribution line; a drivetrain operatively coupled with the vacuum interrupter; an electromagnetic actuator operatively coupled with the drivetrain, the electromagnetic actuator being moveable to a first position effective to move the drivetrain to open the vacuum interrupter and being moveable to a second position effective to move the drivetrain to close the vacuum interrupter; a mechanical opening/closing mechanism including a handle and mechanical connection to the drivetrain, the handle being moveable to move the vacuum interrupter to the first position and to the second position; and a control circuit in operative communication with the electromagnetic actuator and operable to output a first control signal effective to actuate the electromagnetic actuator to move the vacuum interrupter to the first position and to output a second control signal effective to move the electromagnetic actuator to the second position.

In certain forms of the second exemplary embodiment moving the handle from a first handle position to a second handle position actuates a cam to act on a follower that is mechanically coupled to a moveable rod of the drivetrain effective to open the vacuum interrupter. In certain forms moving the handle repeatedly between the second handle position and the first handle position operates a ratcheting mechanism to wind a spring and, after a predetermined number of repeated movements of the handle, the ratcheting mechanism encounters an end feature which prevents further winding of the spring and only allows the handle to move toward the first position. In certain forms moving the handle to the first position when the ratcheting mechanism encounters the end feature is effective to release the wound spring to drive the cam to move the follower and the moveable rod effective to close the vacuum interrupter. In certain forms the mechanical opening/closing mechanism comprises at least one closer body and at least one mechanical biasing element, the mechanical opening/closing mechanism being selectively dischargeable from a charged state to a discharged state, the at least one mechanical biasing element is charged and the at least one closer body is disengaged from the drivetrain when the mechanical opening/closing mechanism is in the charged state, and the at least one mechanical biasing element is discharged to release a first force that displaces the at least one closer body into contact with a pushrod of the drivetrain to close the vacuum interrupter when the mechanical opening/closing mechanism is discharged to the discharged state. In certain forms the mechanical opening/closing mechanism further includes a main bracket, the main bracket being coupled to the at least one closer body, the main bracket being displaced by the first force of the at least one mechanical biasing element. In certain forms the mechanical opening/closing mechanism further includes a release bracket and a main latch, the release bracket being selectively lockable to the main bracket by the main latch, the main latch structured to prevent rotation of at least the main bracket relative to at least the release bracket when the main latch is in a locked position. In certain forms the main latch comprises an upper latch member and a lower latch member, the upper latch member coupled to the main bracket, the lower latch member coupled to the release bracket. In certain forms the mechanical opening/closing mechanism further includes a guide body having a guide rod and a base, the guide rod being slidingly engaged with an arm of the main bracket, the at least one mechanical biasing element being positioned about at least a portion of the guide rod between the arm and the base, the base and the arm being separated by a first linear distance when the mechanical opening/closing mechanism is in the charged state and separated by a second linear distance when the mechanical opening/closing mechanism is in the discharged state, the first linear distance being smaller than the second linear distance. In certain forms the mechanical opening/closing mechanism further includes a linkage system comprising a driving fork, a link guide, a spring arm, and a close latch, a portion of the driving fork pivotally coupled to an elongated guide slot of the link guide, the spring arm pivotally coupled to both an end of the link guide and the base of the guide body and selectively lockingly engages the close latch to prevent rotation of the spring arm in at least one direction. In certain forms the driving fork is configured to be rotated in at least a first direction to translate a second force against the link guide around a first end of the elongated guide slot that displaces the link guide in the first direction, the spring arm being configured to be rotatably displaced in a second direction by displacement of the link guide in the first direction into locking engagement with the close latch, the second direction being a direction opposite of the first direction, and wherein the base of the guide body and the arm of the main bracket are separated by the first linear distance when the spring arm is lockingly engaged with the close latch. In certain forms the linkage system further includes a release link, a first end of the release link being pivotally coupled to the driving fork, a second end of the release link being positioned for engagement with a release pin that is coupled to the release bracket. In certain forms the driving fork is further configured to be rotated in the second direction, the release link being displaced by rotation of the drive fork in the second direction, the release pin being displaced by the displacement of the release link to facilitate rotational displacement of the release bracket in a direction that unlocks the main latch from the locked position. In certain forms the linkage system further includes a secondary latch lever that engages a closer fastener that is coupled to at least one of the at least one closer body, wherein displacement of the closer fastener facilitates rotational displacement of the secondary latch lever, and wherein the secondary latch lever is coupled to the close latch such that rotational displacement of the secondary latch lever in one of the first and second directions rotates the close latch into a position for locking engagement with the spring arm.

A third exemplary embodiment is an apparatus comprising: a current interrupter; an electromagnet actuator; a pushrod coupled to the current interrupter and to the electromagnet actuator, the pushrod being displaceable between at least one of a closed position and an open position in response to a supply of an electrical current to the electromagnet actuator; and a closing mechanism comprising at least one closer body and at least one mechanical biasing element, the closing mechanism being selectively dischargeable from a charged state to a discharged state, wherein the at least one mechanical biasing element is charged and the at least one closer body is disengaged from the pushrod when the closing mechanism is in the charged state, and wherein the at least one mechanical biasing element is discharged to release a first force that displaces the at least one closer body into contact with the pushrod and that displaces the pushrod from the open position to the closed position when the closing mechanism is discharged to the discharged state.

In certain forms of the third exemplary embodiment the electromagnet actuator is a magnetically latching electromagnetic actuator. In certain forms the current interrupter is in an electrically open condition when the electromagnet actuator is at the open position and is in an electrically closed condition when the electromagnet actuator is at the closed position. In certain forms the closing mechanism further includes a main bracket, the main bracket being coupled to the at least one closer body, the main bracket being displaced by the first force of the at least one mechanical biasing element. In certain forms the closing mechanism further includes a release bracket and a main latch, the release bracket being selectively lockable to the main bracket by the main latch, the main latch structured to prevent rotation of at least the main bracket relative to at least the release bracket when the main latch is in a locked position. In certain forms the main latch comprises an upper latch member and a lower latch member, the upper latch member coupled to the main bracket, the lower latch member coupled to the release bracket. In certain forms the closing mechanism further includes a guide body having a guide rod and a base, the guide rod being slidingly engaged with an arm of the main bracket, the at least one mechanical biasing element being positioned about at least a portion of the guide rod between the arm and the base, the base and the arm being separated by a first linear distance when the closing mechanism is in the charged state and separated by a second linear distance when the closing mechanism is in the discharged state, the first linear distance being smaller than the second linear distance. In certain forms the closing mechanism further includes a linkage system comprising a driving fork, a link guide, a spring arm, and a close latch, a portion of the driving fork pivotally coupled to an elongated guide slot of the link guide, the spring arm pivotally coupled to both an end of the link guide and the base of the guide body and selectively lockingly engages the close latch to prevent rotation of the spring arm in at least one direction. In certain forms the driving fork is configured to be rotated in at least a first direction to translate a second force against the link guide around a first end of the elongated guide slot that displaces the link guide in the first direction, the spring arm being configured to be rotatably displaced in a second direction by displacement of the link guide in the first direction into locking engagement with the close latch, the second direction being a direction opposite of the first direction, and wherein the base of the guide body and the arm of the main bracket are separated by the first linear distance when the spring arm is lockingly engaged with the close latch. In certain forms the linkage system further includes a release link, a first end of the release link being pivotally coupled to the driving fork, a second end of the release link being positioned for engagement with a release pin that is coupled to the release bracket. In certain forms the driving fork is further configured to be rotated in the second direction, the release link being displaced by rotation of the drive fork in the second direction, the release pin being displaced by the displacement of the release link to facilitate rotational displacement of the release bracket in a direction that unlocks the main latch from the locked position. In certain forms the linkage system further includes a secondary latch lever that engages a closer fastener that is coupled to at least one of the at least one closer body, wherein displacement of the closer fastener facilitates rotational displacement of the secondary latch lever, and wherein the secondary latch lever is coupled to the close latch such that rotational displacement of the secondary latch lever in one of the first and second directions rotates the close latch into a position for locking engagement with the spring arm. In certain forms the pushrod includes a flange configured for engagement with the at least one closer body at least when the closer is being discharged to the discharged state.

A fourth exemplary embodiment is a closing mechanism for selectively displacing a pushrod that is coupled to an electromagnetic actuator, the closing mechanism comprising: at least one linkage system having a link guide, a spring arm, and a guide body, the spring arm pivotally coupled to both the link guide and the guide body; a main bracket coupled to the guide body, the main bracket configured for at least rotational displacement between a first position and a second position; a main latch adapted to selectively lock the main bracket at the first position of the main bracket; at least one mechanical biasing element positioned between at least a portion of the guide body and a portion of the main bracket; and at least one closer body coupled to the main bracket, wherein the closing mechanism is configured for selective discharging from a charged state to a discharged state, wherein (1) when the closing mechanism is in the charged state, the link guide and the spring arm are both secured at a lifted position, the at least one mechanical biasing element is in a compressed state, the main bracket is locked at the first position by the main latch, and the at least one closer body is at a disengaged position, and (2) when the closing mechanism is discharged from the charged state to the discharged state, the link guide and the spring arm are both lowered from the lifted position, the main latch is unlocked, the main bracket is rotatably displaced toward the second position of the main bracket and further displaced by a force released by the discharging of the at least one mechanical biasing element from the compressed state, and the at least one closer body is moved to an engagement position.

In certain forms of the fourth exemplary embodiment the closing mechanism further includes a release bracket that is selectively lockable to the main bracket by the main latch, and wherein the main latch comprises an upper latch member and a lower latch member, the upper latch member coupled to the main bracket, the lower latch member coupled to the release bracket. In certain forms the at least one linkage system further includes a close latch, and wherein the spring arm lockingly engages the close latch when the spring arm is at the lifted position. In certain forms the at least one linkage system further includes a driving fork that is coupled to the link guide, the link guide and the spring arm being raised to the lifted position by rotation of the driving fork in a first rotational direction, the link guide, but not the spring arm, lowered from the lifted position by rotation of the driving fork in a second rotational direction, the second rotational direction being a direction that is opposite of the first rotational direction. In certain forms the linkage system further includes a release link, a first end of the release link being pivotally coupled to the driving fork, a second end of the release link being coupled to the release bracket, and the release link being structured for displacement at least by rotation of the drive fork in the second rotational direction to facilitate rotational displacement of the release bracket in a direction that rotates the release bracket in a direction that unlocks the main latch from the release bracket. In certain forms the linkage system further includes a secondary latch lever that slidingly engages a closer fastener that is coupled to at least one of the at least one closer body, wherein displacement of the closing mechanism fastener facilitates rotational displacement of the secondary latch lever, and wherein the secondary latch lever is coupled to the close latch such that rotational displacement of the secondary latch lever in one of the first and second rotational directions rotates the close latch into a position for locking engagement with the spring arm. In certain forms the closing mechanism further includes a secondary mechanical biasing element coupled to both a portion of the main bracket and a portion of the linkage system, the secondary mechanical biasing element configured to displace, when the closing mechanism is in the discharged state, the main bracket from the second position to the first position.

A fifth exemplary embodiment is a method for closing a apparatus that includes a current interrupter, an electromagnet actuator, and a pushrod, the method comprising: rotating, in a first rotational direction, a driving fork of a linkage system of a closing mechanism; charging, in response to the rotation of the driving link, a mechanical biasing element between a guide body of the linkage system and a main bracket of the closing mechanism, the main bracket being in a locking engagement with a release bracket during charging of the mechanical biasing element, and wherein the main bracket is coupled to a closer body; rotating, in a second rotational direction, the driving fork, the second rotational direction being opposite of the first rotational direction; displacing, by the rotation of the driving fork in the second rotational direction, another portion of the linkage system; unlocking, by the displacement of the other portion of the linkage system, the locking engagement between the release bracket from the main bracket; discharging, in response to at least the unlocking of the locking engagement between the release bracket and the main bracket, the charged mechanical biasing element; and displacing, using at least a force released by the discharging of the mechanical biasing element, the closer body from a first position to a second position, the closer body coming into engagement with the pushrod and displacing the pushrod from an open position and at least toward a closed position as the closer body is displaced to the second position, the current interrupter being in an electrically opened condition when the pushrod is at the open position, and in an electrically closed condition when the pushrod is at the closed position.

Certain forms of the fourth exemplary embodiment further include, displacing, using at least a force from a secondary mechanical biasing element of the closing mechanism, and after the closer body reaches the second position, the closer body from the second position to the first position.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. An apparatus comprising:

a current interrupter;

an electromagnet actuator;

a pushrod coupled to the current interrupter and to the electromagnet actuator, the pushrod being displaceable between at least one of a closed position and an open position in response to a supply of an electrical current to the electromagnet actuator; and a closing mechanism comprising at least one closer body and at least one mechanical biasing element, the closing mechanism being selectively dischargeable from a charged state to a discharged state, wherein the at least one mechanical biasing element is charged and the at least one closer body is disengaged out of contact with the pushrod when the closing mechanism is in the charged state, and wherein the at least one mechanical biasing element is discharged to release a first force that displaces the at least one closer body into contact with the pushrod and that displaces the pushrod from the open position to the closed position when the closing mechanism is discharged to the discharged state.

2. The apparatus of claim 1, wherein the electromagnet actuator is a magnetically latching electromagnetic actuator.

3. The apparatus of claim 1, wherein the current interrupter is in an electrically open condition when the electromagnet actuator is at the open position and is in an electrically closed condition when the electromagnet actuator is at the closed position.

4. The apparatus of claim 1, wherein the closing mechanism further includes a main bracket, the main bracket being coupled to the at least one closer body, the main bracket being displaced by the first force of the at least one mechanical biasing element.

5. The apparatus of claim 4, wherein the closing mechanism further includes a release bracket and a main latch, the release bracket being selectively lockable to the main bracket by the main latch, the main latch structured to prevent rotation of at least the main bracket relative to at least the release bracket when the main latch is in a locked position.

6. The apparatus of claim 5, wherein the main latch comprises an upper latch member and a lower latch member, the upper latch member coupled to the main bracket, the lower latch member coupled to the release bracket.

7. The apparatus of claim 6, wherein the closing mechanism further includes a guide body having a guide rod and a base, the guide rod being slidingly engaged with an arm of the main bracket, the at least one mechanical biasing element being positioned about at least a portion of the guide rod between the arm and the base, the base and the arm being separated by a first linear distance when the closing mechanism is in the charged state and separated by a second linear distance when the closing mechanism is in the discharged state, the first linear distance being smaller than the second linear distance.

8. The apparatus of claim 7, wherein the closing mechanism further includes a linkage system comprising a driving fork, a link guide, a spring arm, and a close latch, a portion of the driving fork pivotally coupled to an elongated guide slot of the link guide, the spring arm pivotally coupled to both an end of the link guide and the base of the guide body and selectively lockingly engages the close latch to prevent rotation of the spring arm in at least one direction.

9. The apparatus of claim 8, wherein the driving fork is configured to be rotated in at least a first direction to translate a second force against the link guide around a first end of the elongated guide slot that displaces the link guide in the first direction, the spring arm being configured to be rotatably displaced in a second direction by the displacement of the link guide in the first direction into locking engagement with the close latch, the second direction being a direction opposite of the first direction, and wherein the base of the guide body and the arm of the main bracket are separated by the first linear distance when the spring arm is lockingly engaged with the close latch.

10. The apparatus of claim 9, wherein the linkage system further includes a release link, a first end of the release link being pivotally coupled to the driving fork, a second end of the release link being positioned for engagement with a release pin that is coupled to the release bracket.

11. The apparatus of claim 10, wherein the driving fork is further configured to be rotated in the second direction, the release link being displaced by rotation of the drive fork in the second direction, the release pin being displaced by the displacement of the release link to facilitate rotational displacement of the release bracket in a direction that unlocks the main latch from the locked position.

12. The apparatus of claim 11, wherein the linkage system further includes a secondary latch lever that engages a closer fastener that is coupled to at least one of the at least one closer body, wherein displacement of the closer fastener facilitates rotational displacement of the secondary latch lever, and wherein the secondary latch lever is coupled to the close latch such that rotational displacement of the secondary latch lever in one of the first and second directions rotates the close latch into a position for locking engagement with the spring arm.

13. The apparatus of claim 1, wherein the pushrod includes a flange configured for engagement with the at least one closer body at least when the closer is being discharged to the discharged state.

14. A closing mechanism for selectively displacing a pushrod that is coupled to an electromagnetic actuator, the closing mechanism comprising:

at least one linkage system having a link guide, a spring arm, and a guide body, the spring arm pivotally coupled to both the link guide and the guide body;

a main bracket coupled to the guide body, the main bracket configured for at least rotational displacement between a first position and a second position;

a main latch adapted to selectively lock the main bracket at the first position of the main bracket;

at least one mechanical biasing element positioned between at least a portion of the guide body and a portion of the main bracket; and at least one closer body coupled to the main bracket, wherein the closing mechanism is configured for selective discharging from a charged state to a discharge state, wherein (1) when the closing mechanism is in the charged state, the link guide and the spring arm are both secured at a lifted position, the at least one mechanical biasing element is in a compressed state, the main bracket is locked at the first position by the main latch, and the at least one closer body is at a disengaged position, and (2) when the closing mechanism is discharged from the charged state to the discharged state, the link guide and the spring arm are both lowered from the lifted position, the main latch is unlocked, the main bracket is rotatably displaced toward the second position of the main bracket and further displaced by a force released by the discharging of the at least one mechanical biasing element from the compressed state, and the at least one closer body is moved to an engagement position.

15. The closing mechanism of claim 14, wherein the closing mechanism further includes a release bracket that is selectively lockable to the main bracket by the main latch, and wherein the main latch comprises an upper latch member and a lower latch member, the upper latch member coupled to the main bracket, the lower latch member coupled to the release bracket.

16. The closing mechanism of claim 15, wherein the at least one linkage system further includes a close latch, and wherein the spring arm lockingly engages the close latch when the spring arm is at the lifted position.

17. The closing mechanism of claim 16, wherein the at least one linkage system further includes a driving fork that is coupled to the link guide, the link guide and the spring arm being raised to the lifted position by the rotation of the driving fork in a first rotational direction, the link guide, but not the spring arm, lowered from the lifted position by rotation of the driving fork in a second rotational direction, the second rotational direction being a direction that is opposite of the first rotational direction.

18. The closing mechanism of claim 17, wherein the linkage system further includes a release link, a first end of the release link being pivotally coupled to the driving fork, a second end of the release link being coupled to the release bracket, and the release link being structured for displacement at least by rotation of the drive fork in the second rotational direction to facilitate rotational displacement of the release bracket in a direction that rotates the release bracket in a direction that unlocks the main latch from the release bracket.

19. The closing mechanism of claim 18, wherein the linkage system further includes a secondary latch lever that slidingly engages a closer fastener that is coupled to at least one of the at least one closer body, wherein displacement of the closing mechanism faster facilitates rotational displacement of the secondary latch lever, and wherein the secondary latch lever is coupled to the close latch such that rotational displacement of the secondary latch lever in one of the first and second rotational directions rotates the close latch into a position for locking engagement with the spring arm.

20. The closing mechanism of claim 19, wherein the closing mechanism further includes a secondary mechanical biasing element coupled to both a portion of the main bracket and a portion of the linkage system, the secondary mechanical biasing element configured to displace, when the closing mechanism is in the discharged state, the main bracket from the second position to the first position.

21. A method for closing an apparatus that includes a current interrupter, an electromagnet actuator, and a pushrod, the method comprising:

rotating, in a first rotational direction, a driving fork of a linkage system of a closing mechanism;

charging, in response to the rotation of the driving link, a mechanical biasing element between a guide body of the linkage system and a main bracket of the closing mechanism, the main bracket being in a locking engagement with a release bracket during charging of the mechanical biasing element, and wherein the main bracket is coupled to a closer body;

rotating, in a second rotational direction, the driving fork, the second rotational direction being opposite of the first rotational direction;

displacing, by the rotation of the driving fork in the second rotational direction, another portion of the linkage system;

unlocking, by the displacement of the other portion of the linkage system, the locking engagement between the release bracket from the main bracket;

discharging, in response to at least the unlocking of the locking engagement between the release bracket and the main bracket, the charged mechanical biasing element; and displacing, using at least a force released by the discharging of the mechanical biasing element, the closer body from a first position to a second position, the closer body coming into engagement with the pushrod and displacing the pushrod from an open position and at least toward a closed position as the closer body is displaced to the second position, the current interrupter being in an electrically opened condition when the pushrod is at the open position, and in an electrically closed condition when the pushrod is at the closed position.

22. The method of claim 21, further including, displacing, using at least a force from a secondary mechanical biasing element of the closing mechanism, and after the closer body reaches the second position, the closer body from the second position to the first position.

* * * * *